US009834417B2

(12) United States Patent
Jewell

(10) Patent No.: US 9,834,417 B2
(45) Date of Patent: Dec. 5, 2017

(54) PAYLOAD CONTROL APPARATUS, METHOD, AND APPLICATIONS

(71) Applicant: FAIRFIELD INDUSTRIES INCORPORATED, Sugar Land, TX (US)

(72) Inventor: Stephen W. Jewell, Alvin, TX (US)

(73) Assignee: FAIRFIELD INDUSTRIES INCORPORATED, Sugar Land, TX (US)

( * ) Notice: Subject to any disclaimer, the term of this patent is extended or adjusted under 35 U.S.C. 154(b) by 30 days.

(21) Appl. No.: 14/436,105

(22) PCT Filed: Oct. 16, 2013

(86) PCT No.: PCT/US2013/065225

§ 371 (c)(1),
(2) Date: Apr. 16, 2015

(87) PCT Pub. No.: WO2014/062792

PCT Pub. Date: Apr. 24, 2014

(65) Prior Publication Data

US 2015/0266704 A1 Sep. 24, 2015

Related U.S. Application Data

(60) Provisional application No. 61/714,792, filed on Oct. 17, 2012.

(51) Int. Cl.
*B63C 11/44* (2006.01)
*B66D 1/48* (2006.01)
(Continued)

(52) U.S. Cl.
CPC ..... *B66C 13/10* (2013.01); *B63B 27/16* (2013.01); *B66C 13/02* (2013.01); *B66C 13/18* (2013.01); *B66D 1/52* (2013.01)

(58) Field of Classification Search
CPC B63B 27/08; B63C 7/02; B66C 13/06; B66C 13/18; B66C 23/52; B66C 13/02;
(Continued)

(56) References Cited

U.S. PATENT DOCUMENTS 943,509 A * 12/1909 Adam ..... B65H 23/198 104/196
1,281,323 A * 10/1918 Ferris et al. ..... B61B 7/02 104/117
(Continued)

FOREIGN PATENT DOCUMENTS

CN 101466591 A 6/2009
DE 1107311 B 5/1961
(Continued)

OTHER PUBLICATIONS

International Search Report and Written Opinion, International Patent Application No. PCT/US2013/065225, pp. 1-11, International Filing Date Oct. 16, 2013.

*Primary Examiner* — Gregory Adams
(74) *Attorney, Agent, or Firm* — Bond, Schoeneck & King, PLLC; William Greener

(57) ABSTRACT

A payload control apparatus includes a spring-line a spring line actuating mechanism, a spring line flying sheave over which a load line can pass, and a spring line, wherein the spring line flying sheave can move into a position either where the flying sheave is spaced from and in non-contact with or contacting but non-path-altering in relation to the load line, further wherein the spring-line flying sheave can be moved into another position such that the flying sheave engages the load-line and alters its path length. Thus, when a marine surface vessel falls in a heave event that would otherwise cause the payload at the end of the load line to fall as well, the flying sheave will move to increase the path
(Continued)

length causing a shortening of the path length, thereby preventing the payload from falling.

9 Claims, 27 Drawing Sheets

(51) Int. Cl.

| | |
|---|---|
| ***B66D 1/28*** | (2006.01) |
| ***B66C 13/02*** | (2006.01) |
| ***B66C 13/10*** | (2006.01) |
| ***B66C 13/18*** | (2006.01) |
| ***B63B 27/16*** | (2006.01) |
| ***B66D 1/52*** | (2006.01) |

(58) Field of Classification Search
CPC ... B66D 1/26; B66D 1/58; B66D 1/48; B66D 1/50; B66D 1/741; B66D 2700/0108; E21B 19/09; F16L 1/12; F16L 1/207
USPC ..... 166/355; 212/308; 254/277, 327, 337, 254/338, 387, 392, 393, 900; 414/139.6
See application file for complete search history.

(56) References Cited

U.S. PATENT DOCUMENTS 1,592,828 A * 7/1926 Gray ..... B63B 27/04 212/308
3,606,854 A * 9/1971 Van Lunteren ..... B63C 11/44 114/230.27
3,653,635 A * 4/1972 Bates, Jr. ..... E21B 19/09 166/352
3,785,445 A 1/1974 Scozzafava
3,785,511 A * 1/1974 Bonnamy ..... B66C 13/02 254/277
3,894,582 A * 7/1975 Kammerer ..... E21B 19/09 166/355
4,121,806 A 10/1978 Iato et al.
4,157,812 A * 6/1979 Bennett ..... B66D 1/52 242/378.4
4,285,502 A * 8/1981 Lub ..... B66D 1/50 226/118.2
4,522,285 A * 6/1985 Salmon ..... B66B 7/068 104/196
4,724,970 A 2/1988 Kuhn
5,190,107 A 3/1993 Langner et al.
5,894,895 A 4/1999 Welsh
6,082,947 A 7/2000 Anamson
6,595,494 B1 7/2003 Roodenburg et al.
6,926,259 B1 8/2005 Roddenburg et al.
6,926,260 B1 8/2005 De Groot et al.
7,191,837 B2 3/2007 Coles
7,231,981 B2 6/2007 Moe et al.
7,389,973 B1 6/2008 Chou et al.
7,731,157 B2 6/2010 Davidson
7,798,471 B2 9/2010 Christopher
7,934,561 B2 5/2011 Ormond
2005/0242332 A1 11/2005 Ueki et al.
2006/0078390 A1 4/2006 Olsen et al.
2009/0133881 A1 5/2009 Roodenburg et al.
2010/0104372 A1* 4/2010 Lawson ..... G05D 15/01 405/166
2011/0100279 A1* 5/2011 Roodenburg ..... B63B 39/00 114/122
2012/0217063 A1 8/2012 Roodenburg et al.

FOREIGN PATENT DOCUMENTS

NL WO 2007067055 A1 * 6/2007 ..... B66C 13/02
WO 2011152711 A1 12/2011
WO 2012128637 A1 9/2012
WO 2012136350 A1 10/2012

* cited by examiner

- Bend-over-sheave multiplier
  - Entire ascent, decent, and compensating

Mechanical advantage 3

PAYLOAD CONTROL APPARATUS, METHOD, AND APPLICATIONS

BACKGROUND OF THE INVENTION

Field of the Invention

Embodiments of the invention are generally in the field of controlling and/or positioning a physical payload in an unstable medium (e.g., air, water) and, more particularly relate to a method and apparatus for controlling and/or positioning a payload in an unstable medium and compensating for heave or other uncontrolled motion induced by the medium, (e.g., marine wave action), and applications thereof.

Description of Related Art

Heave compensation refers generally to systems that adjust for or otherwise compensate for the motion of a surface ship on equipment suspended overboard in a water column, lifted or lowered through the water column, and or landed on the ocean bottom, a surface platform or dock, or another vessel. In all these cases, the motion of the surface ship induced by wave action acting on it are substantially conveyed, or in some cases amplified and conveyed, to payloads suspended from the ship by rope, cable, chain, belt or similar connecting medium whether flexible or rigid.

FIGS. 1 and 2 illustrate examples of the problem heave compensation systems are intended to address. A surface ship 1 having a deck 10 floats above a surface of a body of water indicated by a waterline 2. The deck 10 is elevated above the waterline 2 and machinery is affixed to it. A crane 40 or similar lifting mechanism is configured so as to be able to lift overboard a payload 60 and raise or lower that payload 60 by rope or cable 30 connected on one end to the payload 60 and on the other end to a winch 20. The cable 30 passes over an overboard-sheave 50 where the direction of the cable 30 is changed from near horizontal to vertical. When at rest, the tension in cable 30 is nominally equal to the weight of the payload 60 plus the weight of the cable 30 between overboard-sheave 50 and payload 60.

In FIG. 2, the ship 1 is raised by wave action above a reference line 100 which it was earlier below as shown in FIG. 1. This happens over a finite period of time wherein the ship 1, and more specifically, the overboard-sheave 50, is accelerated upward. The ship 1 resists this acceleration by settling deeper in the water as indicated by the waterline 2 nearer the deck. The payload 60 also resists this acceleration because of gravity acting on its own mass plus the drag force of the water acting on the payload 60 once in motion. The tension in cable 30 is thereby increased until the vertical velocity of the payload 60 is equal to or exceeds the velocity of overboard-sheave 50. The increased tension in cable 30 can be extreme and introduces loads on all components of the system including the deck 10, the winch 20, the crane 40, the overboard-sheave 50, as well as the payload 60. The entire system must be engineered to withstand the forces that will act on it given a particular sea state defining the safe operating window; otherwise, one or another system component will fail, endangering the mission, equipment, personnel, and/or payload.

When the upward motion of the ship 1 decelerates and subsequently begins to fall back to or through its starting position, all the forces and tensions are reduced but the danger of a mechanical failure is not gone, just delayed until that motion stops. The same drag forces on the payload 60 that worked with gravity to resist its upward movement also act against the payload 60 falling as quickly as gravity alone would cause it to fall. It is in fact possible that overboard-sheave 50 may fall more quickly than the payload 60. This would allow tension in the cable 30 to fall to zero and slack to accumulate in one or more portions of cable 30. In this circumstance the payload 60 is accelerating downward resisted only by its drag in the water and not from any tension earlier supporting it from above by the cable 30. When the downward motion of overboard-sheave 50 ends and is subsequently reversed, the cable 30 will come taut in a "snap load" event. Snap loads can easily exceed the breaking strength of cable 30 and/or the rated operational capacity of other mechanical components of the system. Breakage of the cable 30 and/or damage to other components of the system may result in loss of the payload 60, loss of time and money, as well as cause injury or death.

Heave may be defined as the vertical motion of the overboard-sheave 50 induced by wave action on the vessel, and heave compensation systems are employed to minimize the effects described above thereby widening the safe operating window for the vessel and its machinery in carrying out its mission.

FIG. 3 illustrates a conventional example of a passive heave compensation system that is entirely spring based. It is passive because once engaged, it requires no extra energy beyond the energy introduced into the system by the motion of the ship and payloads themselves. Deck 10, winch 20, cable 30, overboard-sheave 50, and payload 60 are as illustrated in earlier figures. Overboard-sheave 50 is supported by crane 40 (not shown) as before. Two sheave-blocks 70 and 80 are separated from each other by a spring 90. Sheave block 70 is fixed in place, and may be referred to as a "fixed sheave-block", while sheave-block 80 is movable, and may be referred to as a "flying sheave-block". The flying sheave-block 80 optionally moves vertically inside a support structure (not shown) that keep it stably centered over the fixed sheave-block 70. As illustrated, the spring 90 is substantially vertically oriented with sheave-blocks 70, 80 aligned one above the other, but horizontal arrangements are possible and common. Cable 30, which in earlier figures passed from winch 20 directly over overboard-sheave 50, instead first makes a complete path around both the fixed sheave-block 70 and the flying sheave-block 80 before making its way over the overboard-sheave 50. One complete path around both sheave-blocks 70, 80 is illustrated but multiple passes, typically 2 (mechanical advantage of 4), are often employed so that shorter excursions of the flying sheave-block 80 can accommodate longer heave excursions at the expense of a stronger spring. Other sheave arrangements are possible and easily comprehended by those skilled in the art.

FIG. 3A shows the reaction of machinery in FIG. 2 to an upward heave event. The upward heave A increases tension on the cable 30 and causes the spring to be compressed, reducing the distance between the sheave-blocks B, and freeing some portion of cable 30 that passes around the sheave-blocks to be released as illustrated. During a downward heave event A shown in FIG. 3B, reduced tension on the cable 30 will allow the spring to expand, increasing the distance between the sheave-blocks B, which in turn takes up what might otherwise be slack in rope 30. One can see that the spring constant must be matched to the load, which includes the payload 60 plus the weight of cable 30 between overboard-sheave 50 and the payload 60. If friction is ignored, the passive system just described is closely analogous to a spring 70 inserted in rope 30 between overboard-sheave 50 and the payload as illustrated in FIG. 4.

In practice, it is not practical to change coil springs based on the mass of the load being handled. Springs in passive heave systems as described are instead "gas springs," and the typical components are illustrated in FIG. 5. A gas spring 200 consists of a piston 210 free to move inside a piston housing 220, with a bottom seal 230. The piston has seals 211 that prevent gas from passing between the piston 210 and piston housing 220. At the bottom of the piston housing 220 there is plumbing that allows gas to pass freely between the piston assembly 239 and an accumulator 240. The volume inside the piston housing 220 below the piston seals 211 together with volume inside the accumulator 240 constitutes a pressure vessel. The volume of the pressure vessel is further increased by plumbing in a series of gas bottles 250. The gas is typically nitrogen or air, but other gases may be utilized. As the piston 210 is advanced into the piston housing 220, the gas beneath the seals 211 is displaced and therefore compressed uniformly inside all the components making up the pressure vessel. Neglecting well understood details regarding temperature and non ideal gases, the spring constant of the system is adjusted by varying the pressure inside the gas filled portion of the gas spring 200 relying on Boyles Law, where pressure p multiplied by volume v is a constant. The fully pneumatic spring of FIG. 5 represents a passive heave spring but typically a combination gas-over-fluid spring, as illustrated in FIG. 6 is used for reasons unimportant to this discussion. In such springs, the piston housing 220 is filled with fluid 241 beneath the piston seals 211, as is a substantial portion of the accumulator 242 and the plumbing 235 connecting the two. When the piston 210 is advanced into the piston housing 220, instead of compressing gas directly, it displaces hydraulic fluid into the bottom of the accumulator. The gas-fluid interface 243 is inside the accumulator 240. As the level of fluid in the accumulator 240 is increased, it compresses the gas in the upper portion of the accumulator 240 and the remainder of the pressure vessel in just the same manner that the piston itself would in the all pneumatic version of FIG. 5.

The spring constant in a gas spring is easily adjusted by changing the pressure in the pressure vessel.

FIG. 7 shows the principle components of a gas spring in a passive heave compensation system as discussed. The system illustrated and discussed herein above had a single pneumatic or hydraulic piston, but there can be more than one piston (often two) between the flying sheave-block 80 and the fixed sheave-block 70 usually feeding the same accumulator 240.

Passive heave compensation systems based on gas springs are widely used, simple, and very effective at insulating cable 30 from extreme fluctuations in tension. However the spring only responds to changes in the tension of rope 30 at the overboard sheave 50, and any change in this tension will cause the payload 60 to be displaced vertically in the water column. That tension is nominally equal to the weight in water of the payload 60 plus the weight in water of the rope 30 between the overboard sheave 50 and the payload 60. This can be defined as "active-load" and is a largely invariant physical property of payload 60, rope 30, and the earth's gravity. Absent heave, the weight-on-sheave (WOS) at the overboard sheave 50 will nominally be equal to the active-load. However, the WOS is sensitive to heave due to the payload's inertia and the drag forces acting on the payload 60 and rope 30. If the WOS at overboard sheave 50 exceeds the active-load, the payload 60 will be lifted in the water column. And if the WOS at overboard sheave 50 is below the active-load, the payload 60 will fall in the water column.

In addition, the spring cannot respond until the differential tension is sufficient to overcome the friction in the system components, which can be significant. There is substantial friction a) between the seals 211 and the piston housing, b) in the sheaves turning on their shafts, which is increased with increased active-load, and c) between the flying sheave-block and its support structure (if used; not shown) that constrain its motion. Added to the friction in the machinery, cable 30 is likely a relatively large wire rope, synthetic rope, or armor shielded umbilical. Such ropes and cables do not bend easily over a sheave and once bent, resist counter deformation. Added to this is the inertia in all of the massive metal moving parts, which resist being set in motion in the first place, but are particularly resentful of changing direction. Finally, the spring stored energy will be recovered when the heave action is decelerated or reversed. Transmissibility is a well understood property of springs, is frequency sensitive, and is defined as the ratio between output and input amplitude of the spring.

For all of these reasons spring based passive systems are deficient at maintaining a payload 60 stationary in the water column.

When residual motion of the payload 60 is too extreme for the particular mission's purpose, active heave compensation must be employed. Active systems directly control the pay-out and take-up of cable 30 passing over the overboard sheave 50 and/or the elevation of the overboard sheave 50 so as to ideally compensate for the motion of the ship 1, limited principally by the ability to measure and anticipate that motion. Measurement and forecast is typically left to a motion reference unit (MRU) composed of computer, software, and input from various sensors. These systems are complicated and expensive, but even if perfect at measuring and predicting the motion, making real time adjustments in these physical systems (winch 20 start, stop, reverse (FIG. 8)/sheave elevation/crane 40 adjustments (FIG. 9)) typically require substantial additional power (hydraulic or electric) and substantial strengthening of associated machinery, further increasing the cost.

There are active systems that incorporate passive systems as described hereinabove. In these cases, the active system provides power assist (usually hydraulic) to override the motion of the flying sheave-block 80. Such systems are called active-over-passive (AOP) systems as diagramed in FIGS. 10 and 11. FIG. 10 is different diagrammatically but operationally identical to passive gas-spring compensation systems as already discussed. FIGS. 11 and 12 show the addition of a hydraulically implemented active override 300. One can see why these systems need little added power: the spring is doing the lion's share of the work just as it did acting alone passively. The only extra force required is that needed to overcome friction in the system, the energy stored in the spring when displaced from its neutral set-point, and the inertia in the moving parts.

FIG. 13 shows a block diagram of the active-over-passive system described. The motion of the vessel is monitored by a motion reference unit (MRU). The motion at the overboarding sheave and the adjustments necessary to compensate for this are computed in a computer or a programmable logic controller (PLC) from the data provided by the MRU. The PLC then directs hydraulic fluid to actuate the hydraulic cylinder in the appropriate direction. The actual motion is fed back to the PLC from a measuring device. The active portion of the system as described is implemented with a hydraulic cylinder but those skilled in the art will recognize other mechanisms could be used to add the necessary energy, such as, e.g., a motor driving a rack and pinion.

FIG. 14 depicts another shortcoming with gas-spring compensation systems, whether active or passive. The lift line carrying the payload being compensated traverses all the sheaves of the gas spring. This is true not just when compensating, but for the entire ascent and descent from the vessel to the final operating depth. At each sheave the rope or wire bends over that sheave causing wear. We refer to this as "inline compensation," and all inline compensators are bend-over-sheave (BOS) multipliers. The lift line, whether wire or new synthetic fiber, may be three or more miles long in marine operations, for example, and cost in excess of $150,000; thus wear and deterioration of the rope is a serious matter even without considering the value of the payload connected to the vessel by this single thread. It is also difficult to monitor the condition of the rope over its entire length during routine operations.

For all of the aforementioned reasons there exists a need for a low power payload control apparatus and heave compensation systems (active or passive) and associated methods in which the heave-compensated load line is not required to traverse the sheaves of the gas-spring doing most of the work.

SUMMARY

An embodiment of the invention is a payload control apparatus that includes a spring-line assembly, including a spring line actuating mechanism, a spring-line flying sheave assembly including at least a flying sheave over which a load line can pass, and a spring line having one end connected to the spring line actuating mechanism and another end connected to the spring line flying sheave assembly, wherein the spring line flying sheave assembly can be moveably disposed via the spring line actuating mechanism into at least one position such that the flying sheave is in either a non-contacting, spaced relation or a non-path-altering, contacting relation to a region of the load line having a straight load-line path length, $L_1$, in local proximity to the flying sheave, wherein the load-line is connected at one region thereof to a winch assembly and at another region thereof to a payload to be controllably lifted, lowered, positioned, or maintained in a stationary location, further wherein the spring-line flying sheave assembly can be moveably disposed via the actuating mechanism into at least another position such that the flying sheave is in engaging contact with the load-line region in proximity to the flying sheave in a manner that alters the straight load-line path length, $L_1$, such that the altered load-line path is not straight and has a path length, $L_2$, that is greater than $L_1$. It is to be clear to the reader that the length of the load line between the winch and the payload does not change regardless of the heaving motion of the vessel; rather, according to the invention, the path of the load line between the winch and the payload is changed by the displacement of the flying sheave. Thus, for illustration, when the vessel falls in a heave event that would otherwise cause the payload to fall as well, the flying sheave will act to increase the path length local to the flying sheave traversed by the load line therein causing a shortening of the path length subsequent to the flying sheave thereby preventing the payload from falling. In various non-limiting aspects, the payload control apparatus may further include or be further characterized by the following features or limitations:

wherein the spring line is a rigid medium;

wherein the spring line is a flexible medium;

wherein the spring line is one of a rope and a cable;

wherein the load and at least a portion of the load-line are disposed in a water column;

further comprising one or more rotatable, positionally fixed sheaves disposed in the load-line path in contact with or contactable with the load line, whereby the one or more fixed sheaves provide load-line path stabilization when the spring-line assembly flying sheave is disposed in the path-altering, engaging contact position with the load-line;

wherein $\Delta L = L_2 - L_1$ is controllably variable;

wherein the spring-line assembly further comprises a spring line flying sheave assembly guiding structure providing a flying sheave assembly path within which the spring-line assembly flying sheave is moveably disposed so as to direct the motion of the flying sheave along the sheave path;

further comprising an active compensator operably coupled to the guiding structure and the spring-line assembly sheave;

wherein the active compensator includes a motion feedback control component and at least one of a motorized rack and pinion assembly, a hydraulic cylinder, a pneumatic cylinder, a third driven line, a traction winch, or the like;

wherein the spring line actuating mechanism includes a spring and at least one rotatable and movable sheave acted on by the spring.

wherein the spring is a pneumatic spring;

wherein the spring is a hydro-pneumatic spring;

wherein the spring line actuating mechanism includes a passive heave compensation device of any form;

wherein the one end of the spring line is affixed to the spring line actuating mechanism;

wherein the one end of the spring line is affixed to the at least one movable sheave of the spring line actuating mechanism.

An embodiment of the invention is a method for controlling a payload that is desired to be raised, lowered, positioned, or maintained in a position in an unstable medium. The method includes the steps of providing a payload attached to a load-line having a locally straight load-line path and providing a payload control apparatus as described hereinabove; and utilizing the payload control apparatus stabilize the payload in the unstable medium. According to an aspect, the unstable medium is water.

DETAILED DESCRIPTION OF NON-LIMITING, EXEMPLARY EMBODIMENTS OF THE INVENTION

Figure 1:
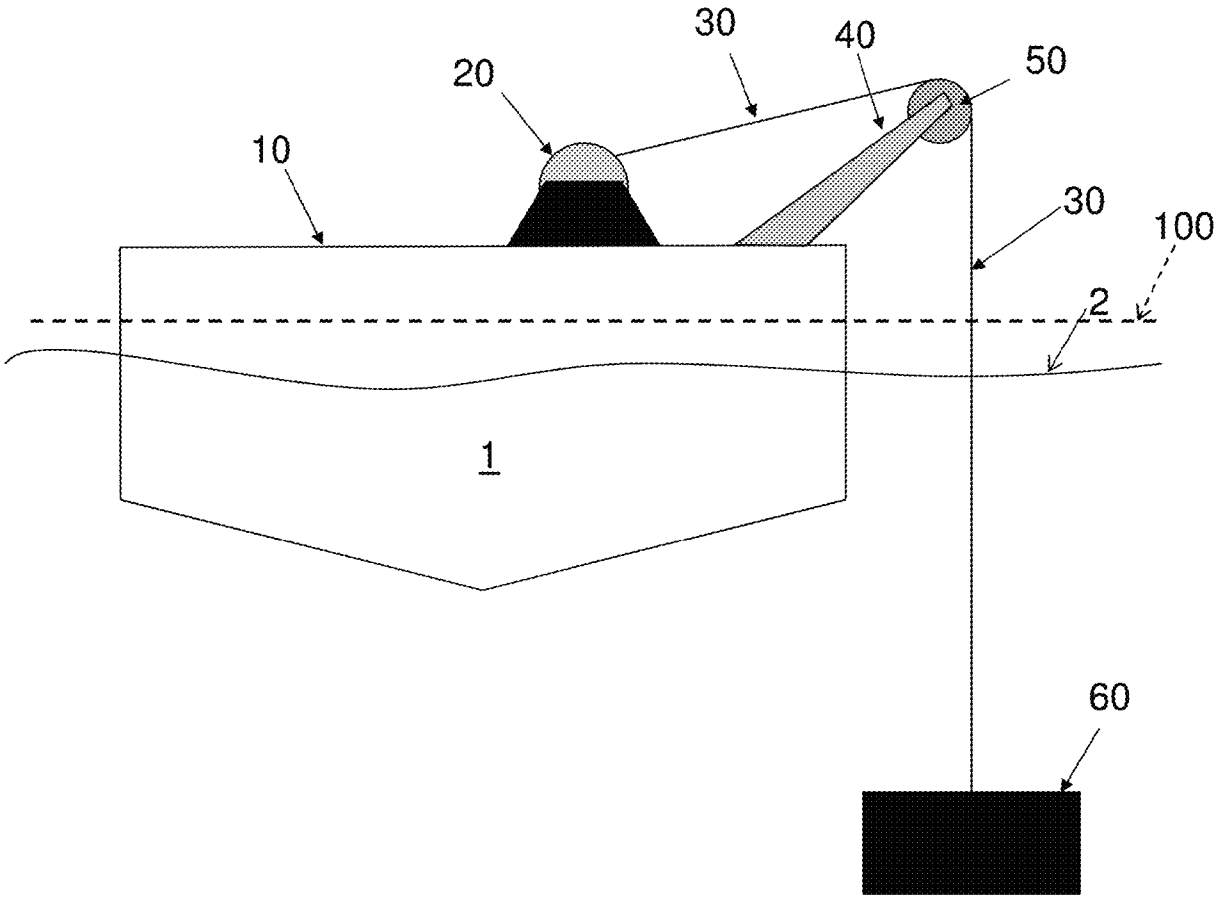
Figure 1 (PRIOR ART)
FIGS. 1-14 are diagrams illustrative of the current state of the technology and the shortcomings thereof.
Figure 2:
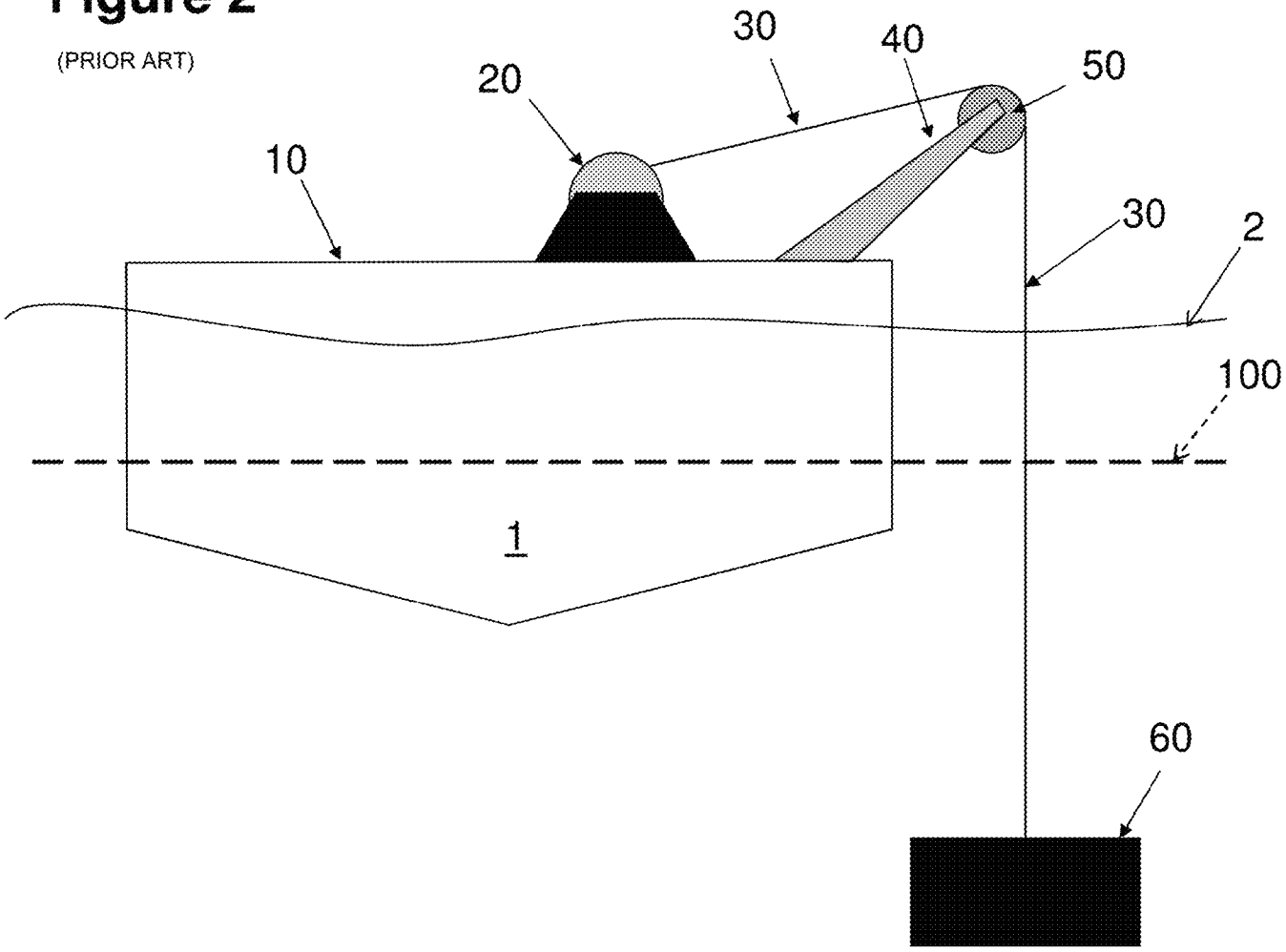
Figure 2 (PRIOR ART)
Figure 3:
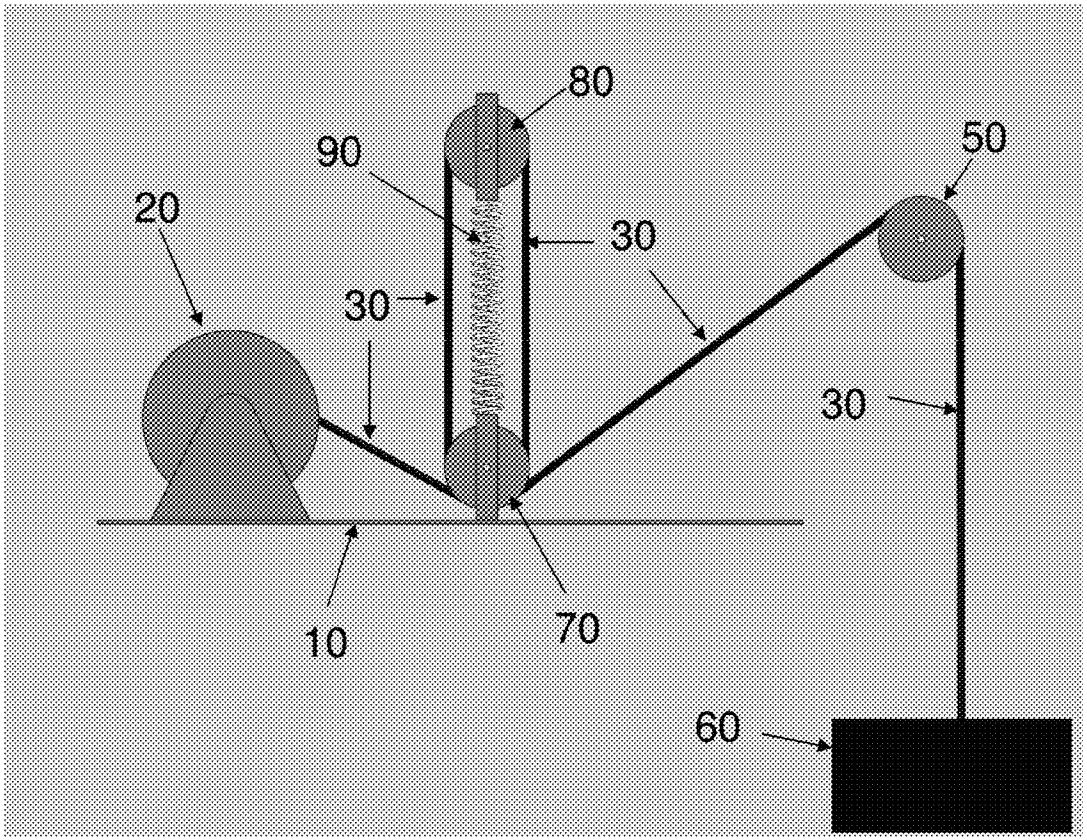
Figure 3 (PRIOR ART)
Figure 3A:
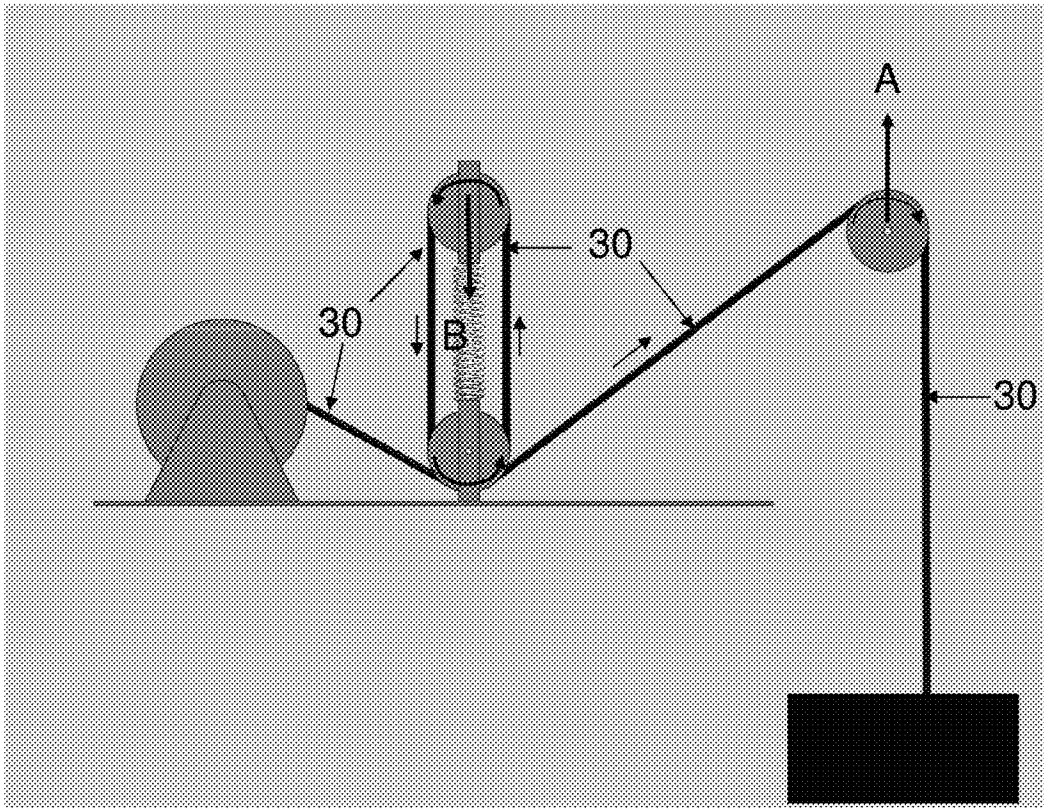
Figure 3A (PRIOR ART)
Figure 3B:
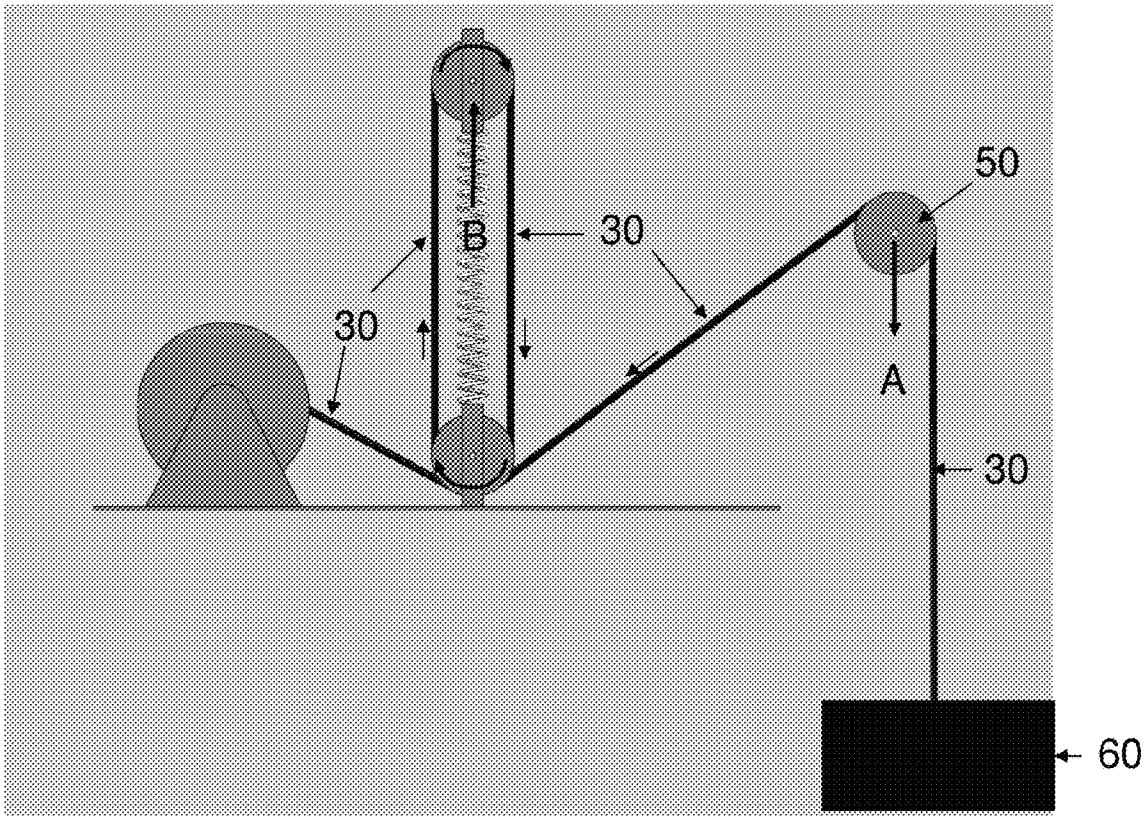
Figure 3B (PRIOR ART)
Figure 4:
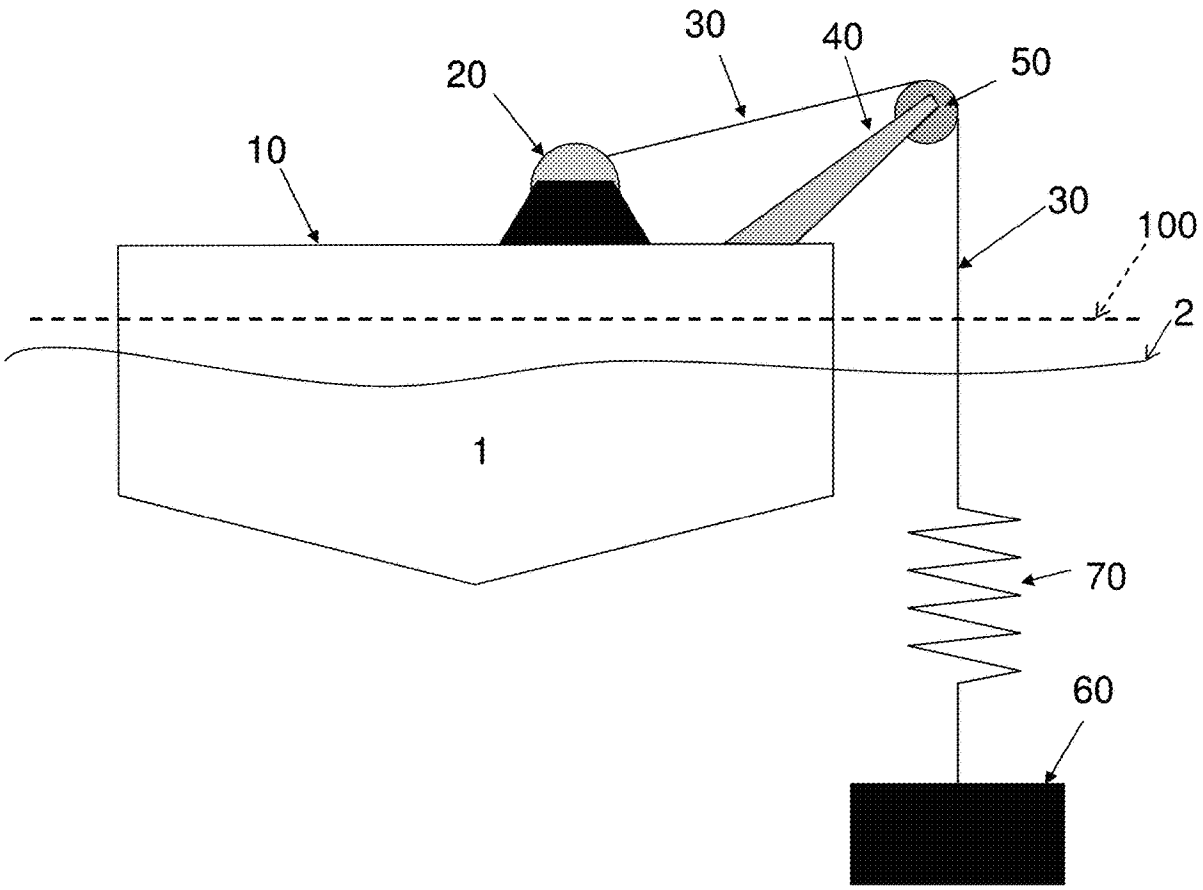
Figure 4 (PRIOR ART)
Figure 5:
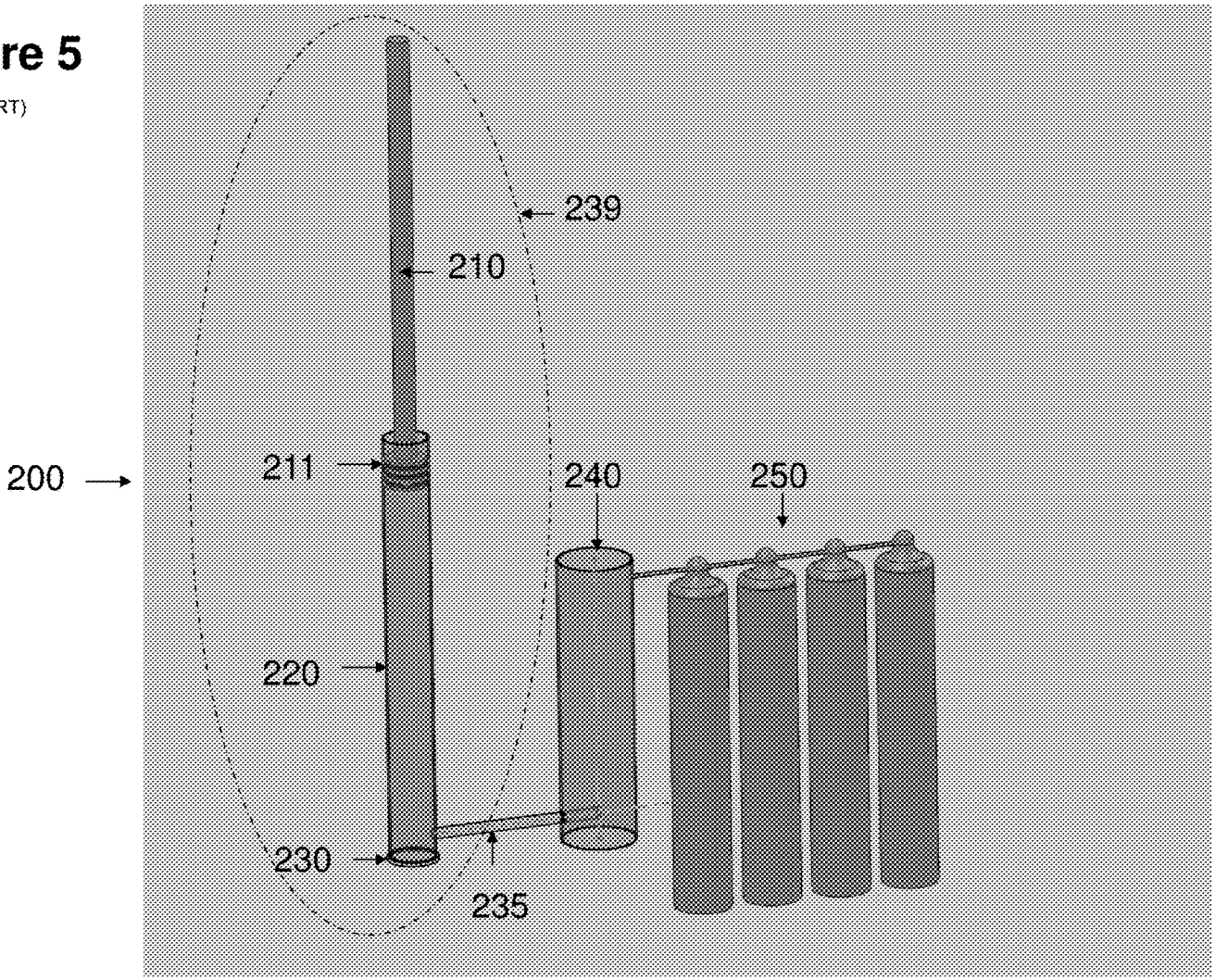
Figure 5 (PRIOR ART)
Figure 6:
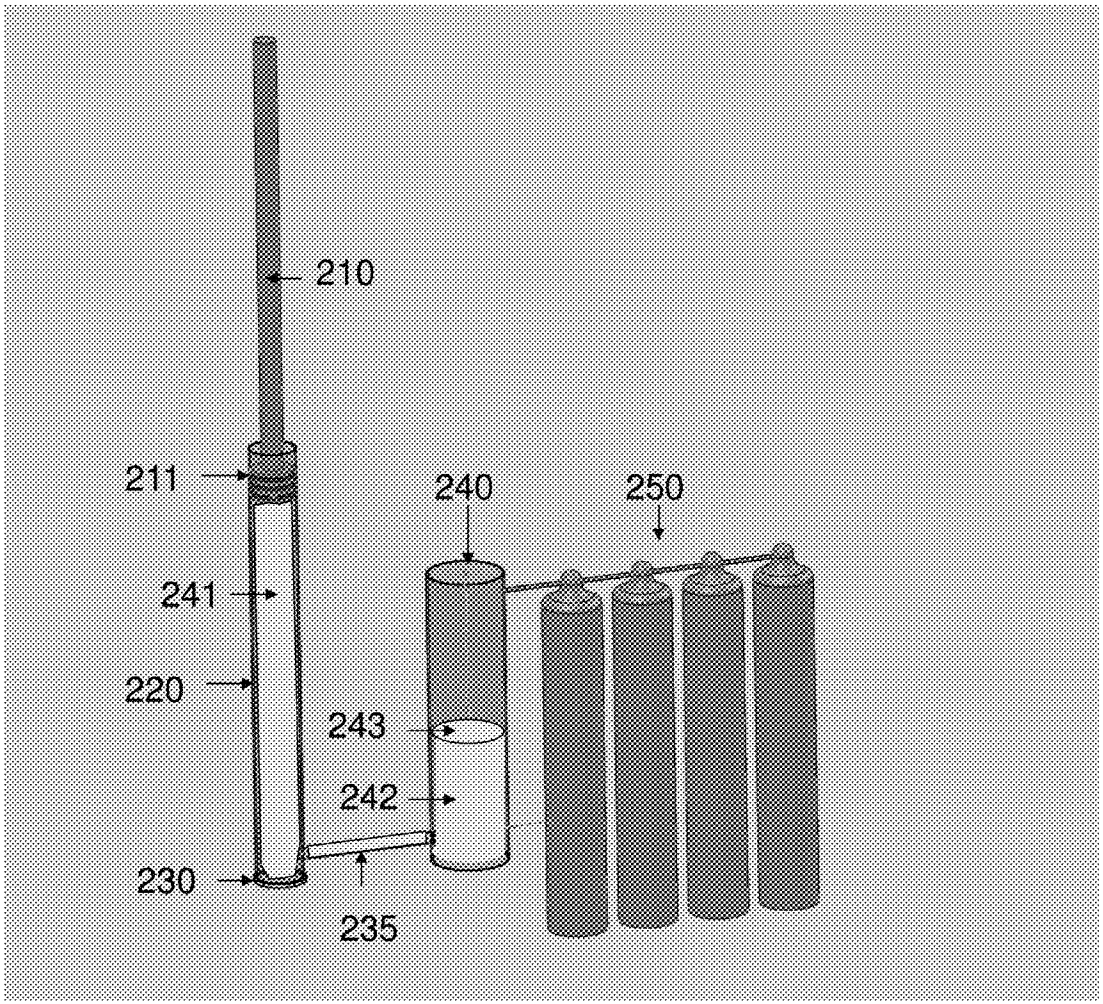
Figure 6 (PRIOR ART)
Figure 7:
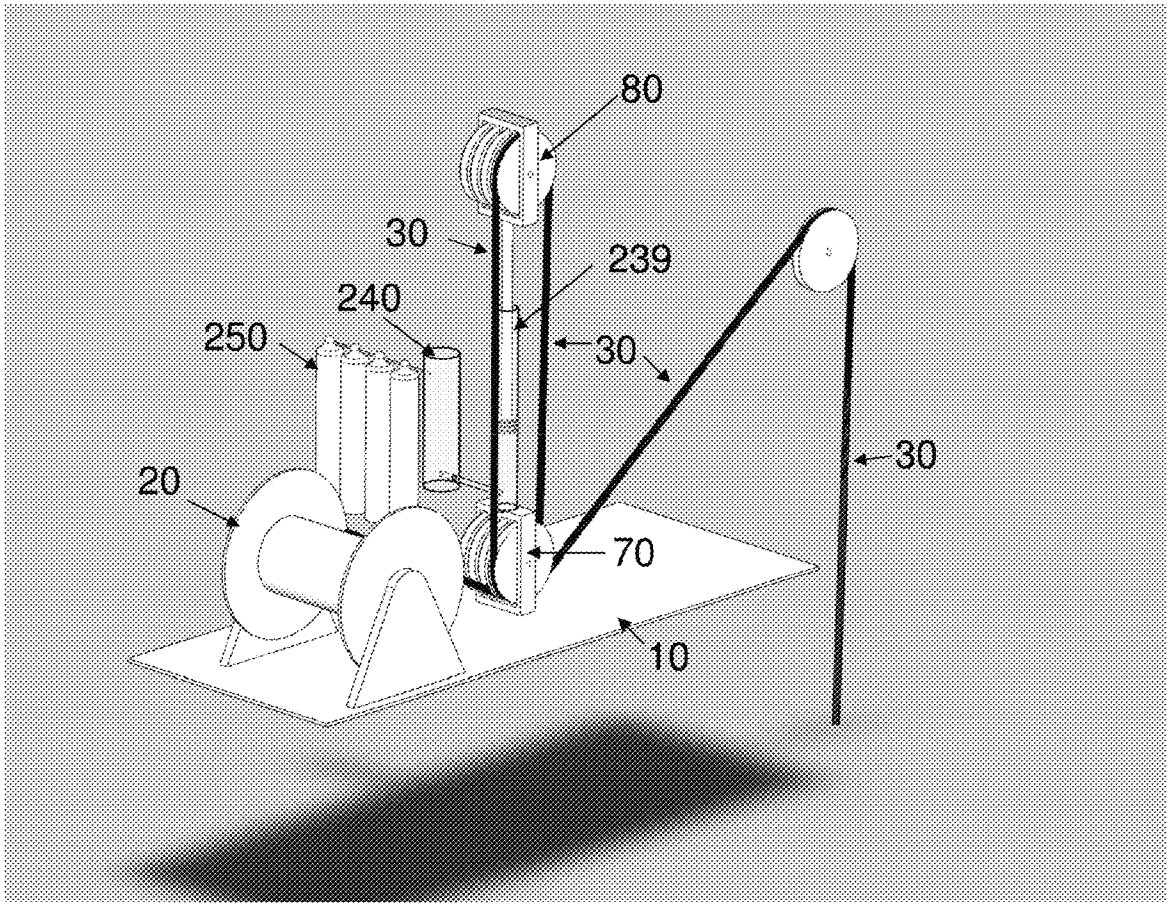
Figure 7 (PRIOR ART)
Figure 8:
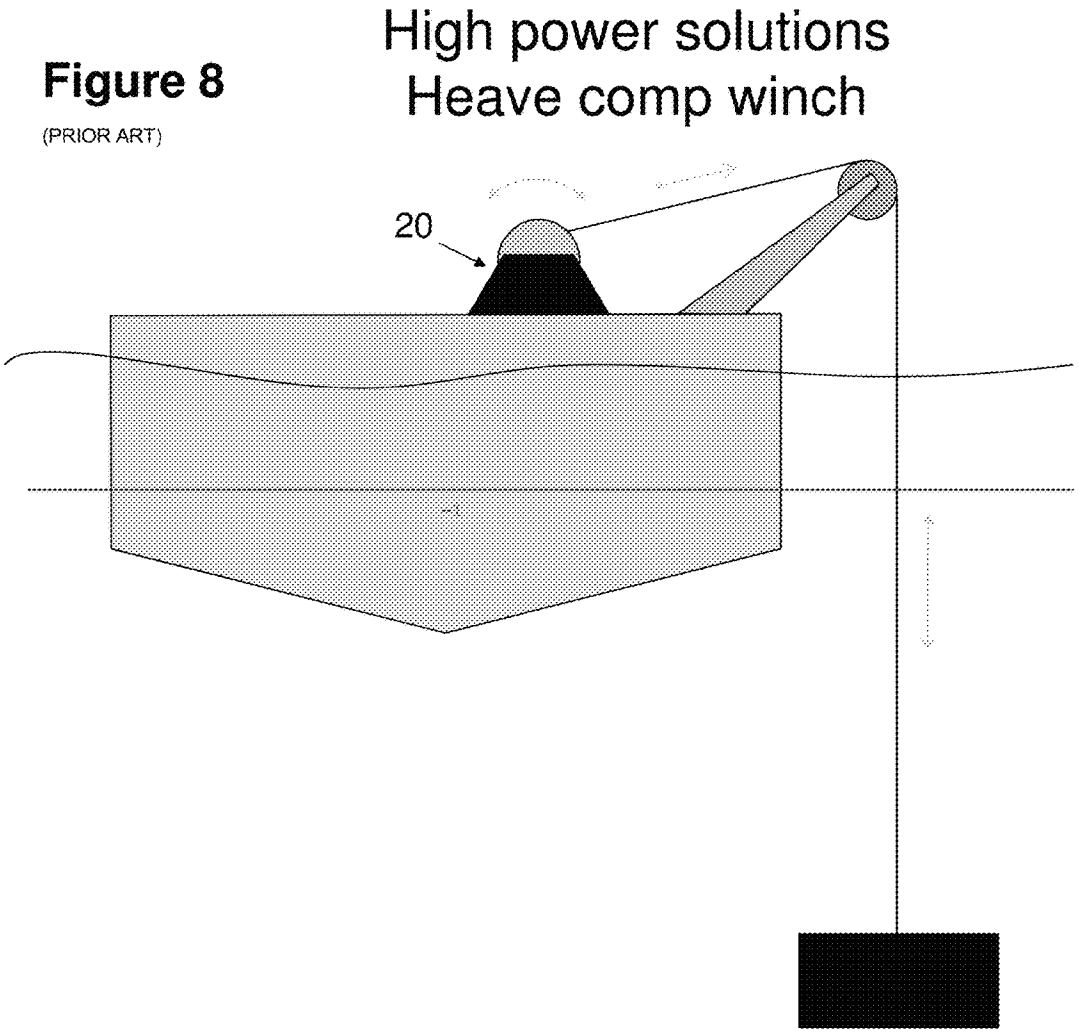
Figure 8 (PRIOR ART)
Figure 9:
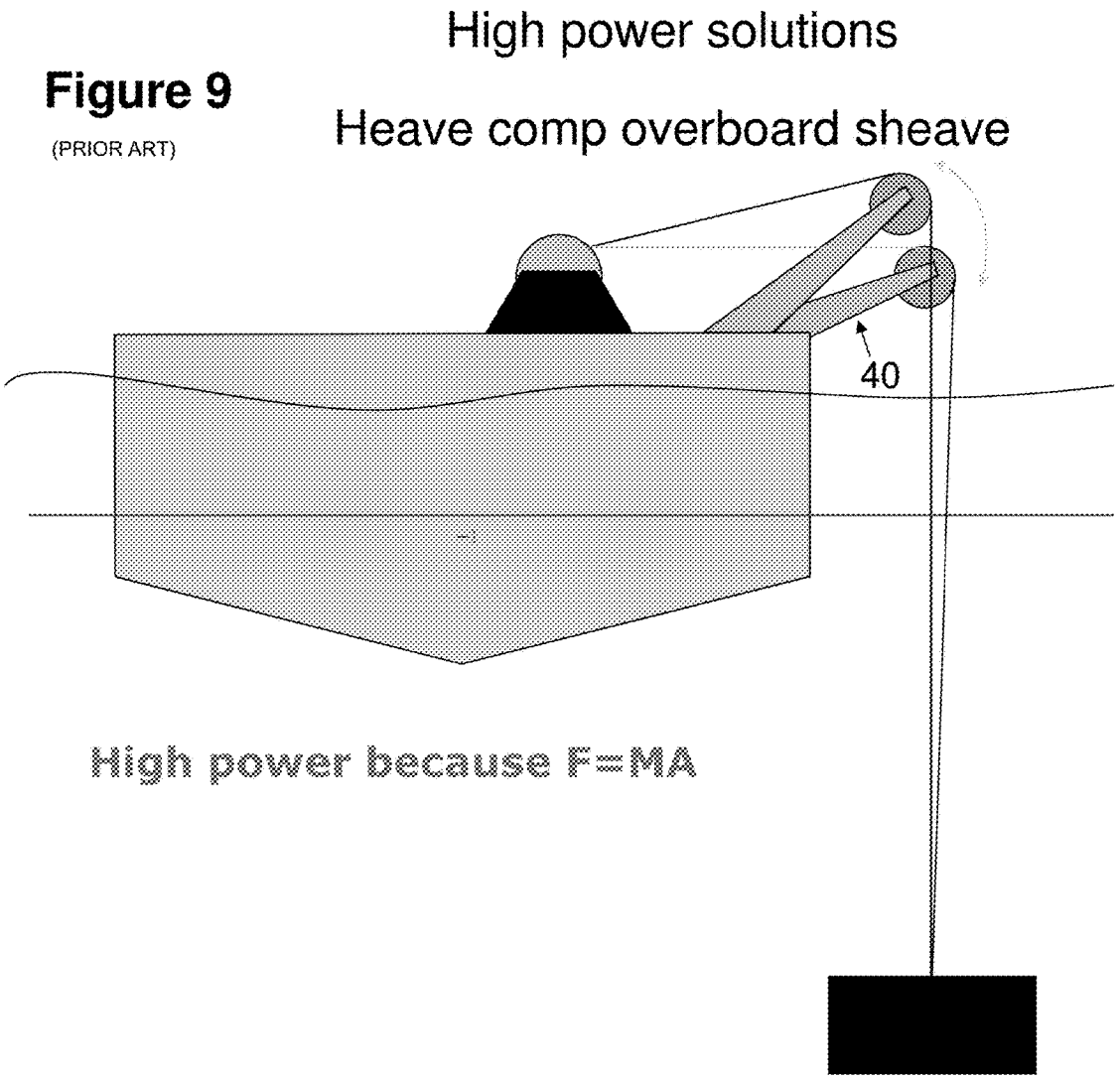
Figure 9 (PRIOR ART)
Figure 10:
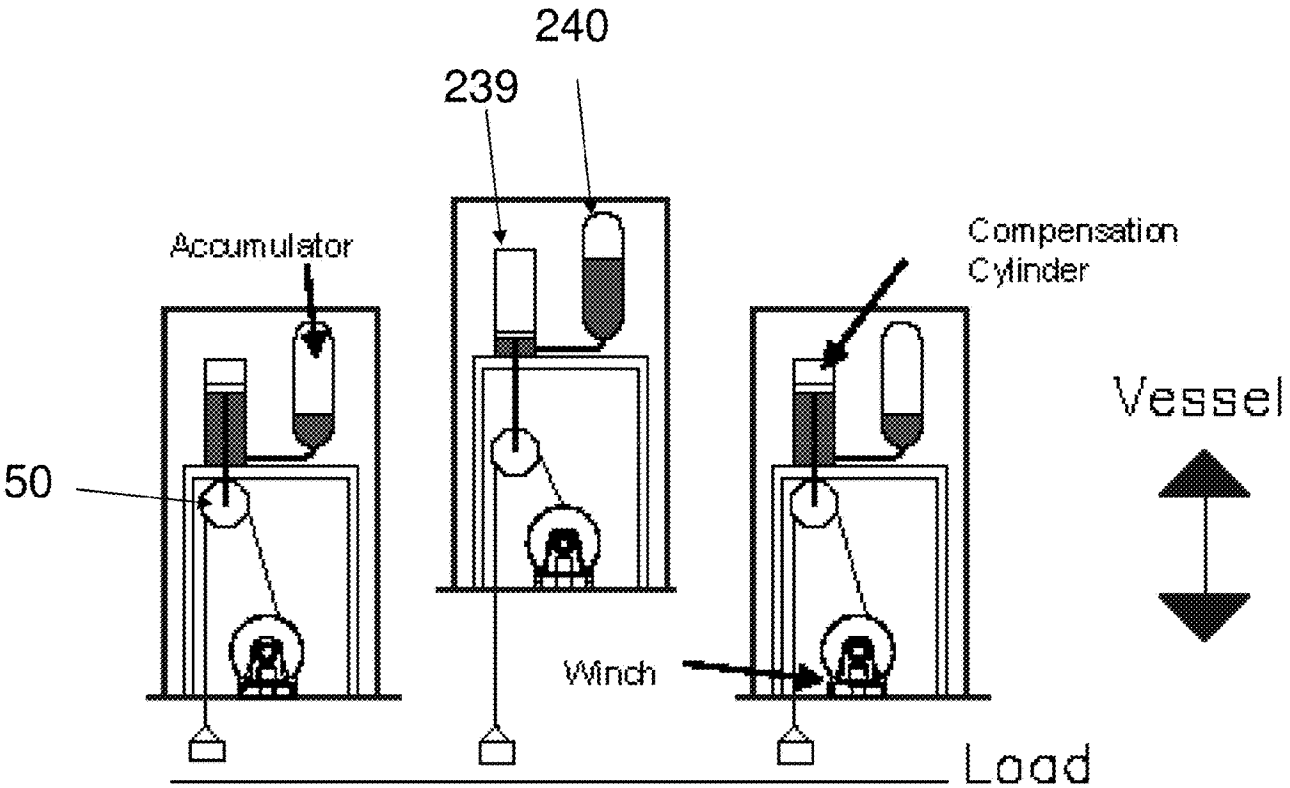
Figure 10 (PRIOR ART)
Figure 11:
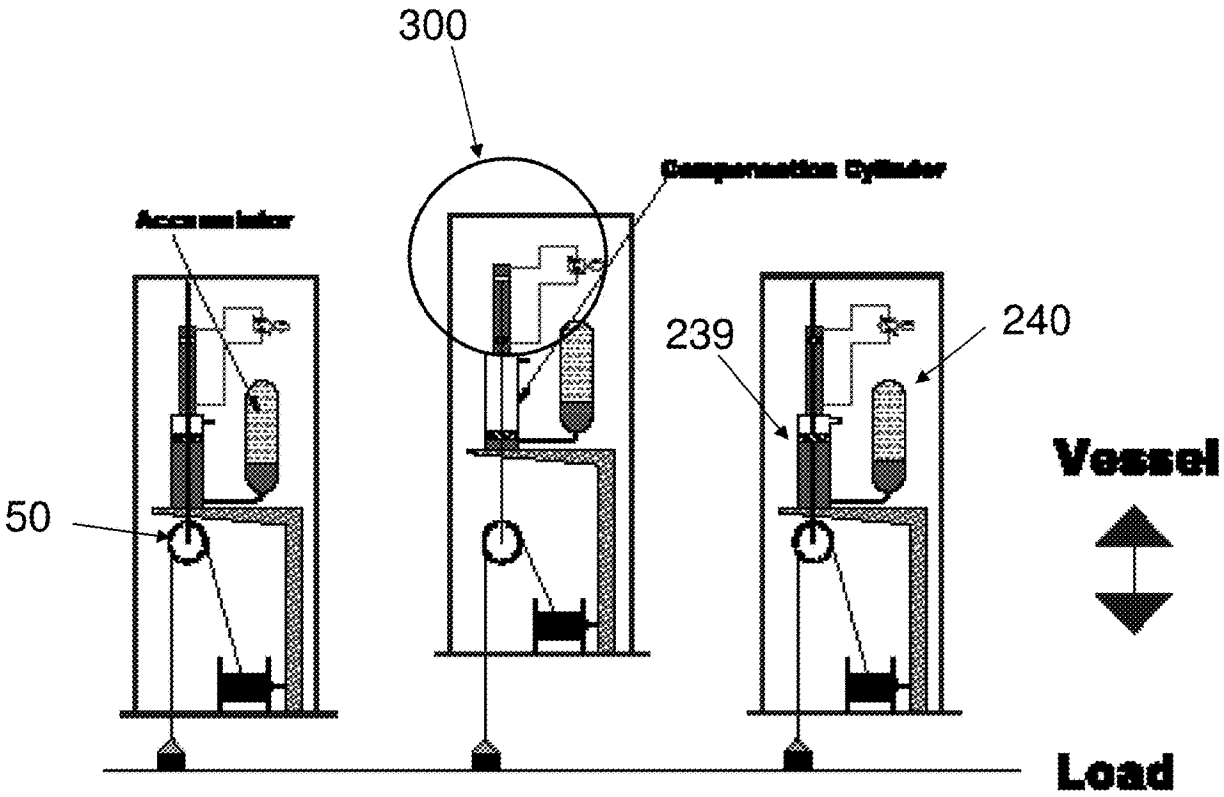
Figure 11 (PRIOR ART)
Figure 12:
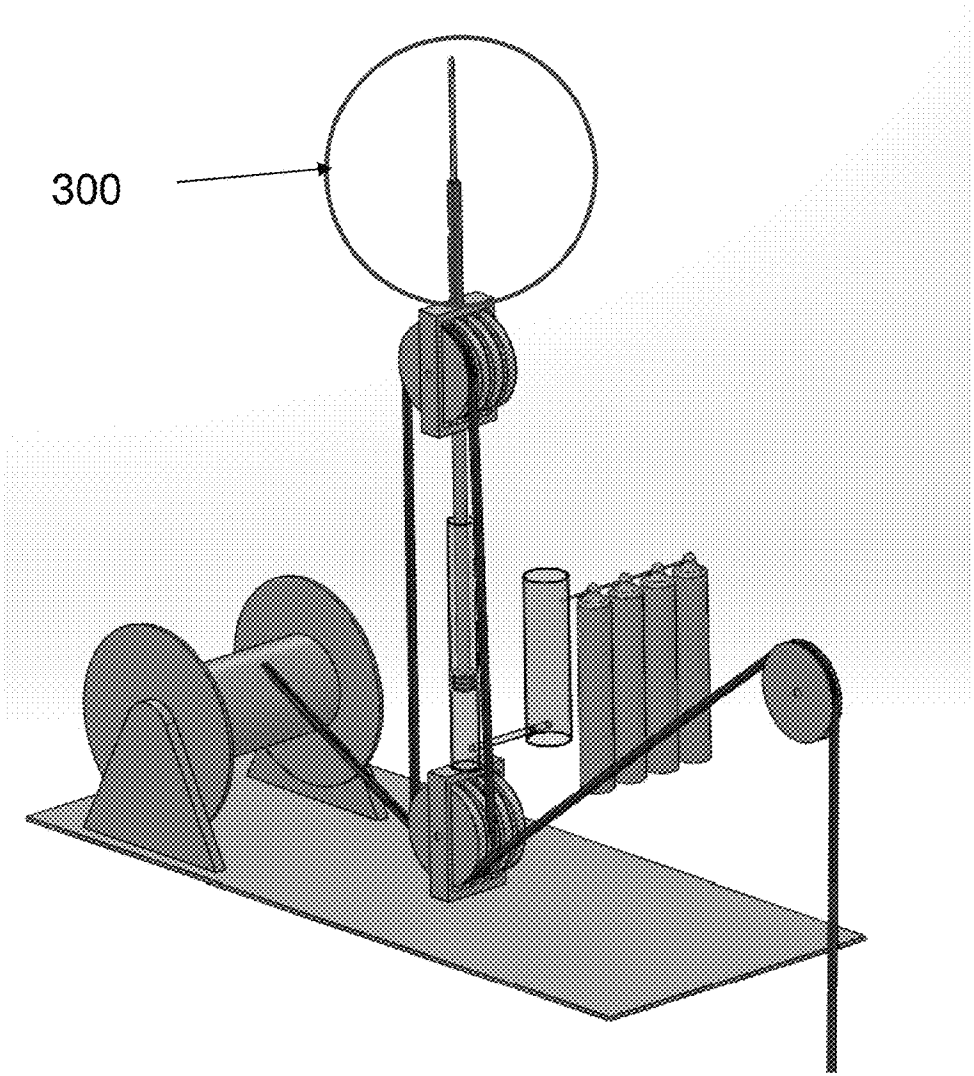
Figure 12 (PRIOR ART)
Figure 13:
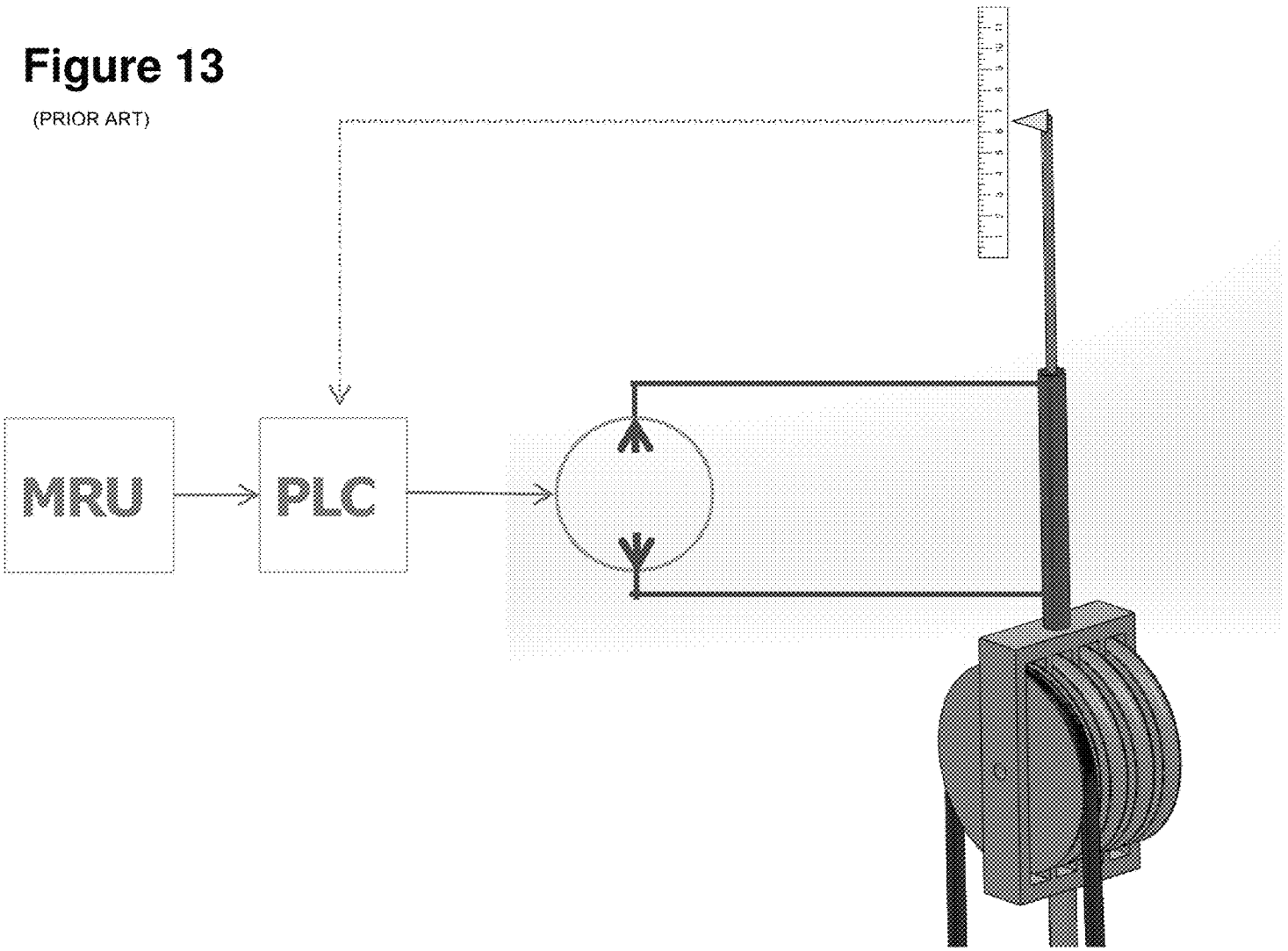
Figure 13 (PRIOR ART)
Figure 14:
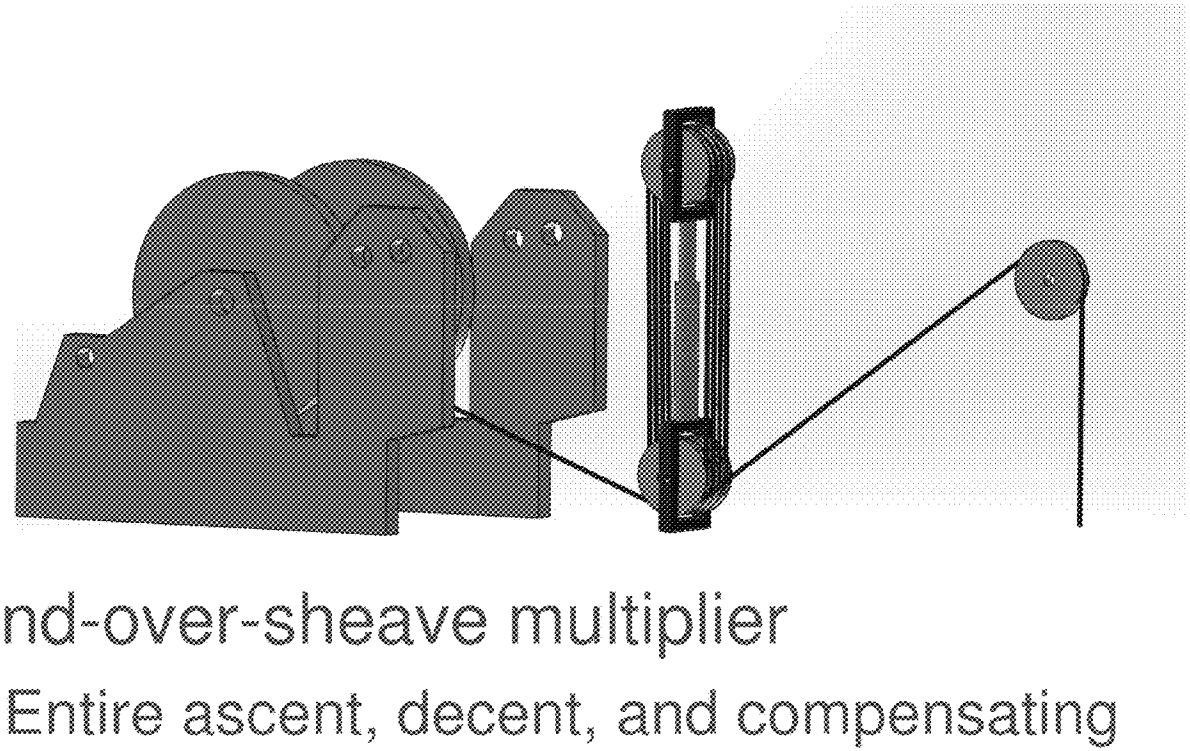
Figure 14 (PRIOR ART)
Figure 15:
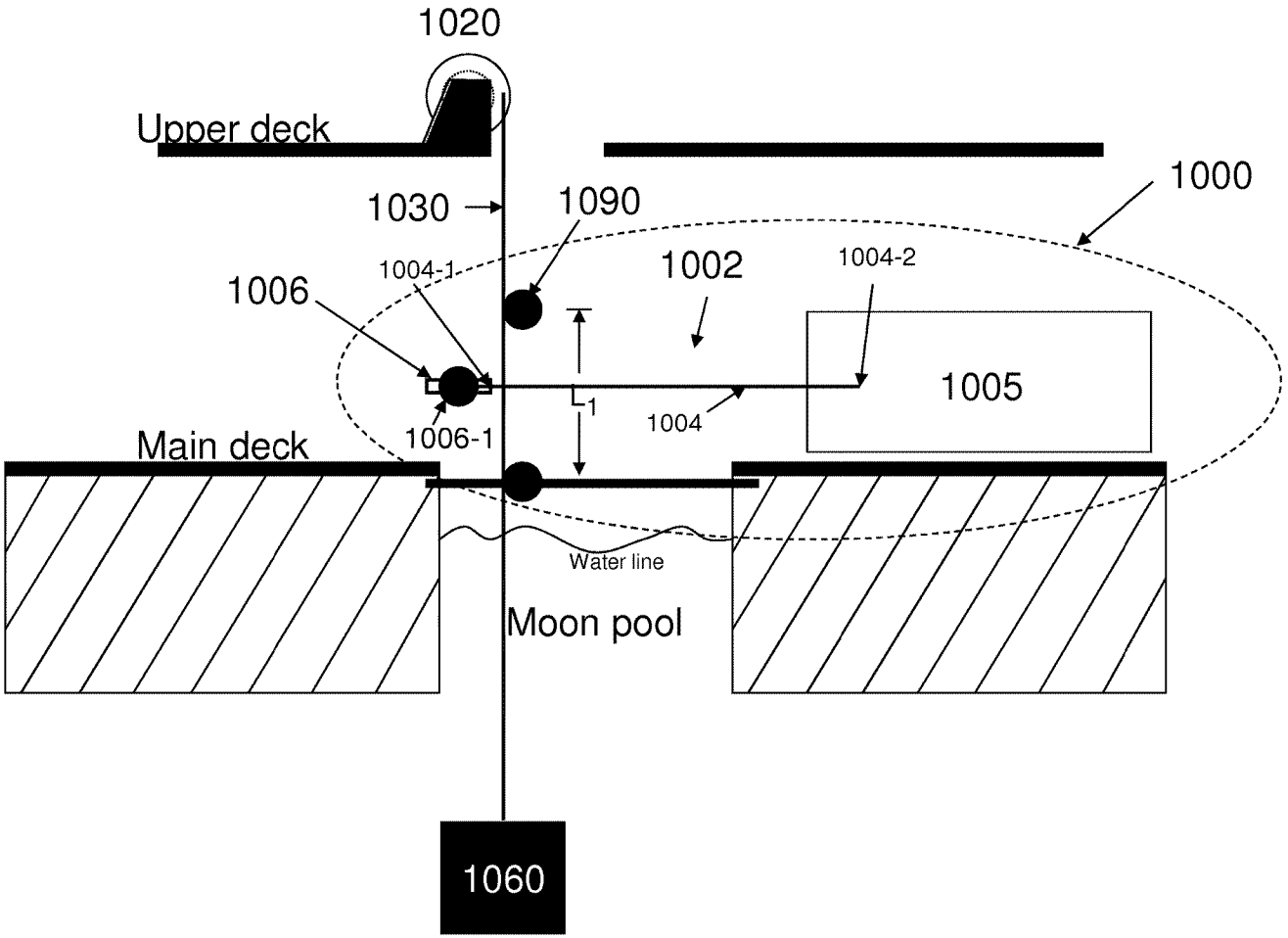
FIG. 15 is a drawing that schematically illustrates a payload control apparatus in an unengaged state, according to an embodiment of the invention.

An embodiment of a payload control apparatus 1000 is illustrated in FIG. 15. In the aspect shown, the apparatus is in an unengaged state. Although a winch 1020, load 1060, and an upper deck and main deck of a marine vessel are illustrated, they do not form a part of the invention per se; rather, they assist in illustrating the operation of the invention.

Figure 16:
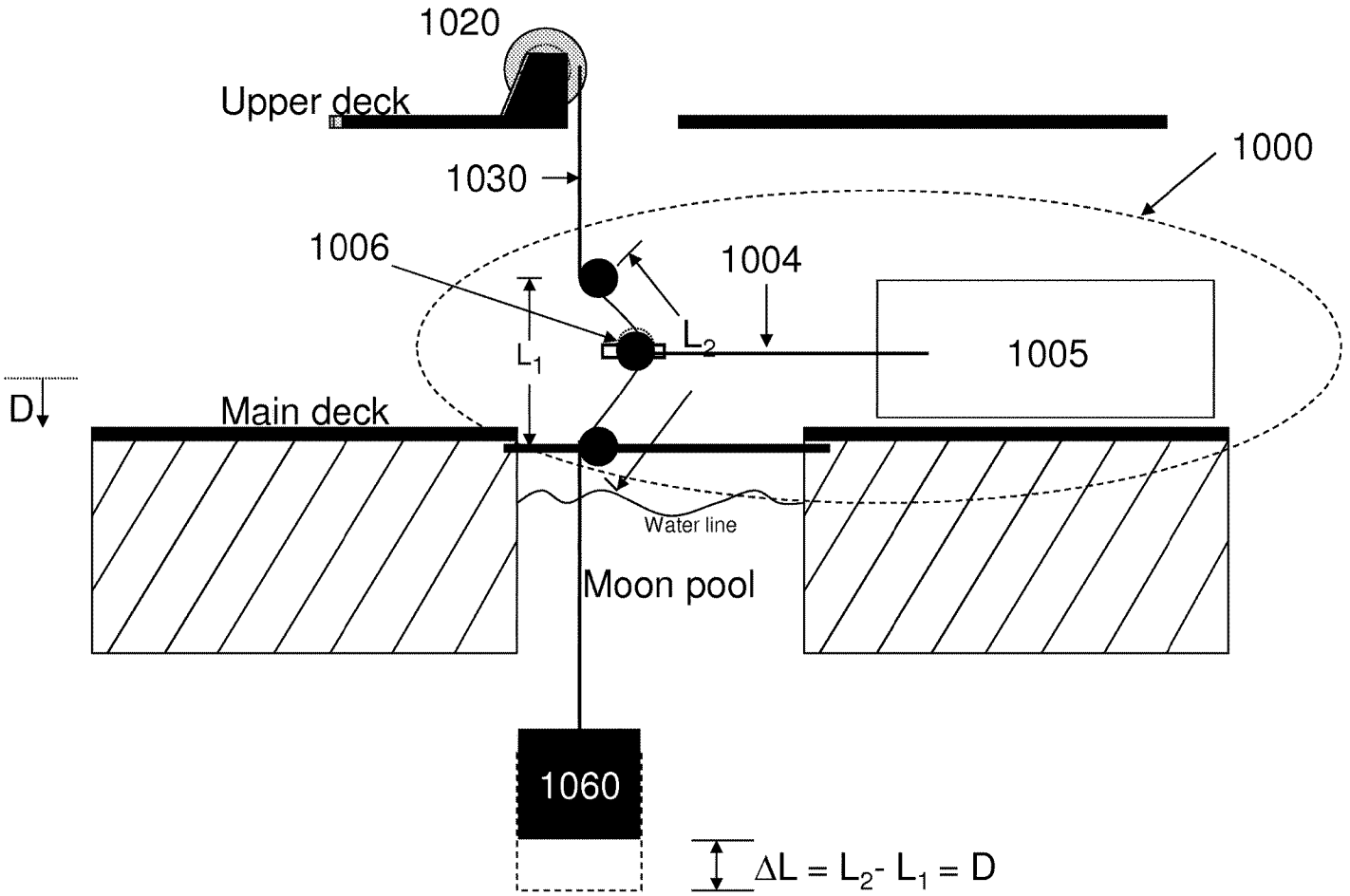
FIG. 16 is a drawing that schematically illustrates the payload control apparatus shown in FIG. 15 in an engaged state, according to an aspect of the invention.
Figure 18:
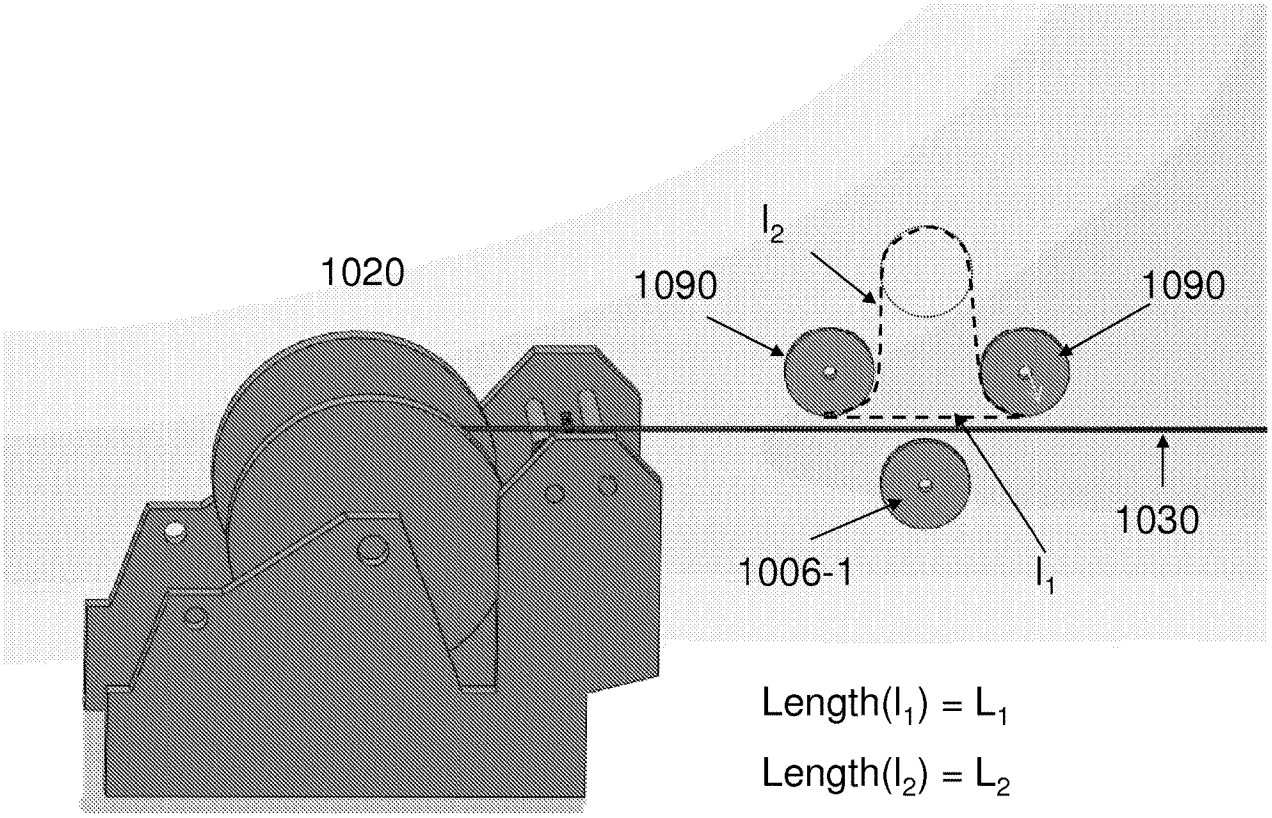
FIG. 18 diagrammatically illustrates the locally straight unaltered path $l_1$ of length $L_1$ and the lengthened path $l_2$ of length $L_2$ when the apparatus is engaged according to an illustrative embodiment of the invention.

The apparatus 1000 includes a spring-line assembly 1002, including a spring line actuating mechanism 1005, a spring-line flying sheave assembly 1006 including at least a flying sheave 1006-1 over which a load line (1030) can pass; and a spring line 1004 having a second end 1004-2 connected to the spring line actuating mechanism and a first end 1004-1 connected to the spring line flying sheave assembly 1006. The spring line flying sheave assembly 1006 can be moveably disposed via the spring line actuating mechanism into at least one position such that the flying sheave 1006-1 is either in a non-contacting, spaced relation with a section of the load line 1030 (see FIG. 15) or in a non-path-altering, contacting relation to a region of a straight load-line path having a length $L_1$ (FIGS. 18 and 19) of the load-line that is connected at a second end thereof to the winch assembly 1020 and at another region (first end) thereof to the payload 1060 to be controllably lifted, lowered, positioned, or maintained in a stationary location. The spring-line flying sheave assembly 1006 further can be moveably disposed via the actuating mechanism into at least another position such that the flying sheave 1006-1 is in a path-altering, engaging contact position (see FIG. 16) with the region of the straight load-line path of the load-line (also FIGS. 18 and 20) such that the load-line path is not straight and has a local load line path length $L_2$ that is greater than load line path length $L_1$. It is to be clear to the reader that the length of the load line between the winch and the payload does not change regardless of the heaving motion of the vessel; rather, according to the invention, the path of the load line between the winch and the payload is changed by the displacement of the flying sheave. FIG. 16 shows a heave event where the vessel fell by a distance D and the load was adjusted by an equal amount $\Delta L=L_2-L_1$ thereby holding the payload 1060 steady in the water column.

Figure 17:
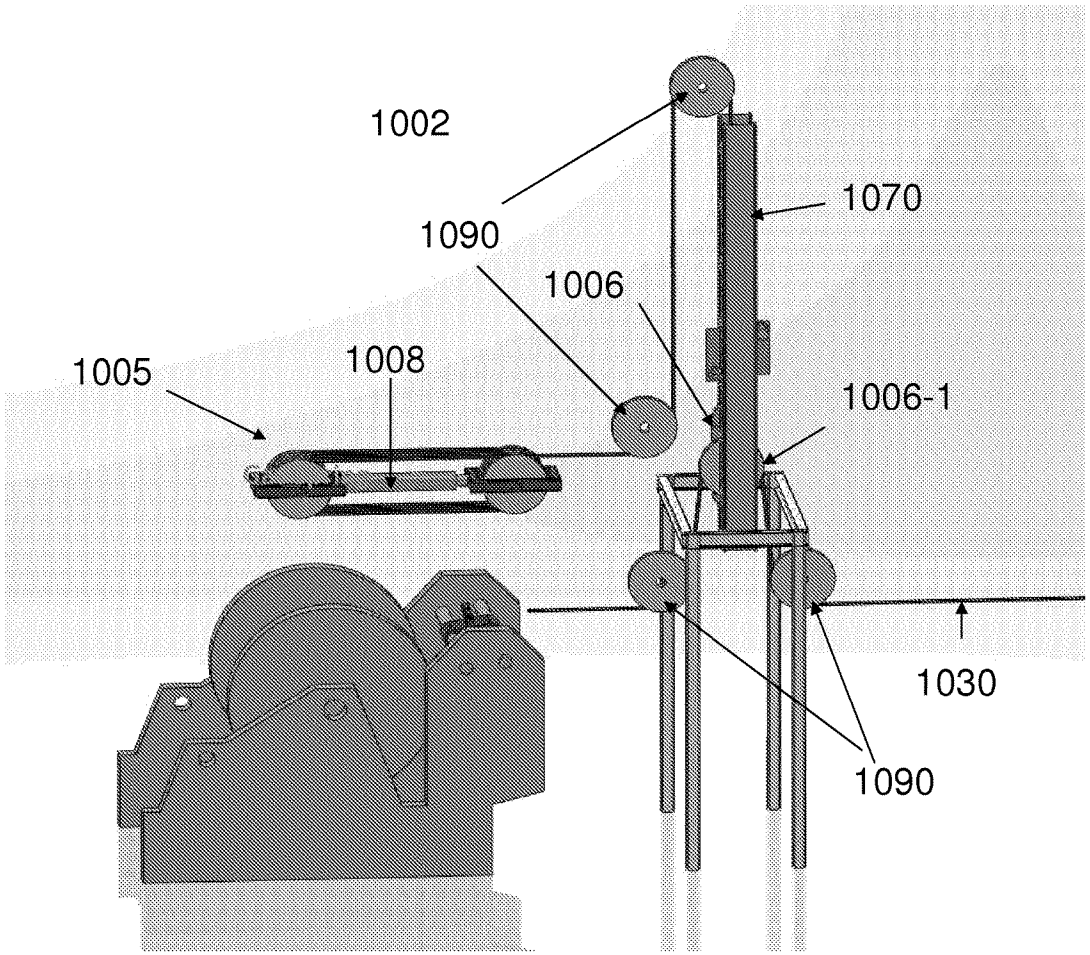
FIG. 17 diagrammatically illustrates a payload control apparatus in an engaged states according to an illustrative embodiment of the invention.
Figure 19:
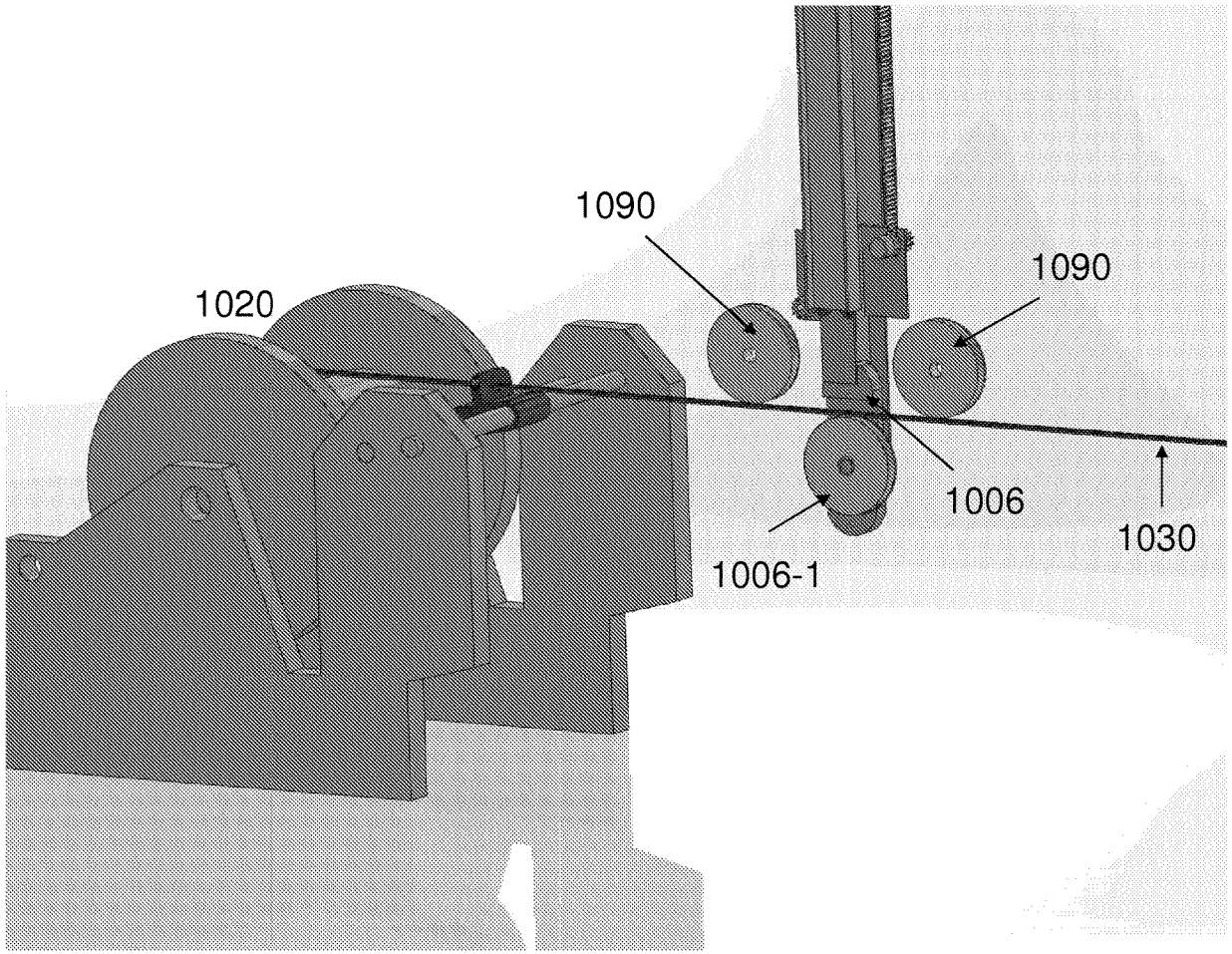
FIG. 19 shows a flying sheave assembly portion of the payload control apparatus of FIG. 17 in an unengaged state.
Figure 20:
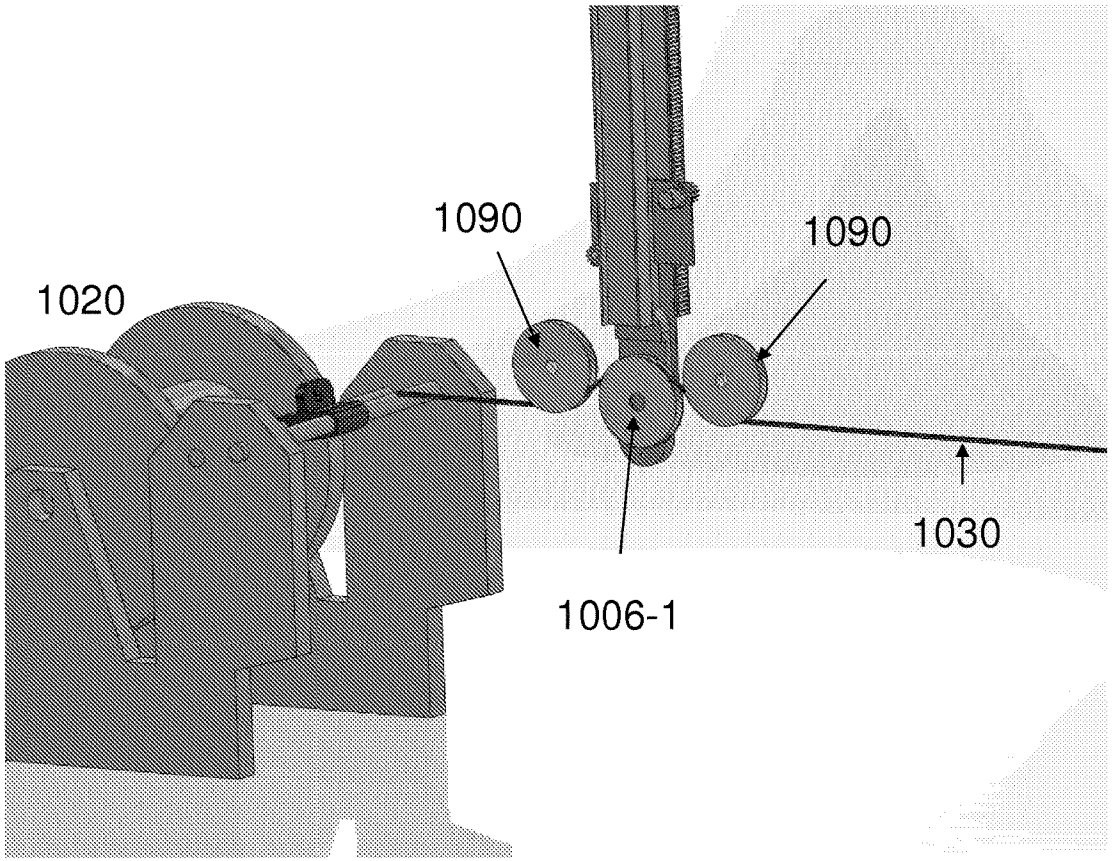
FIG. 20 shows the flying sheave assembly portion of the payload control apparatus of FIG. 19 in an engaged state.
Figure 21:
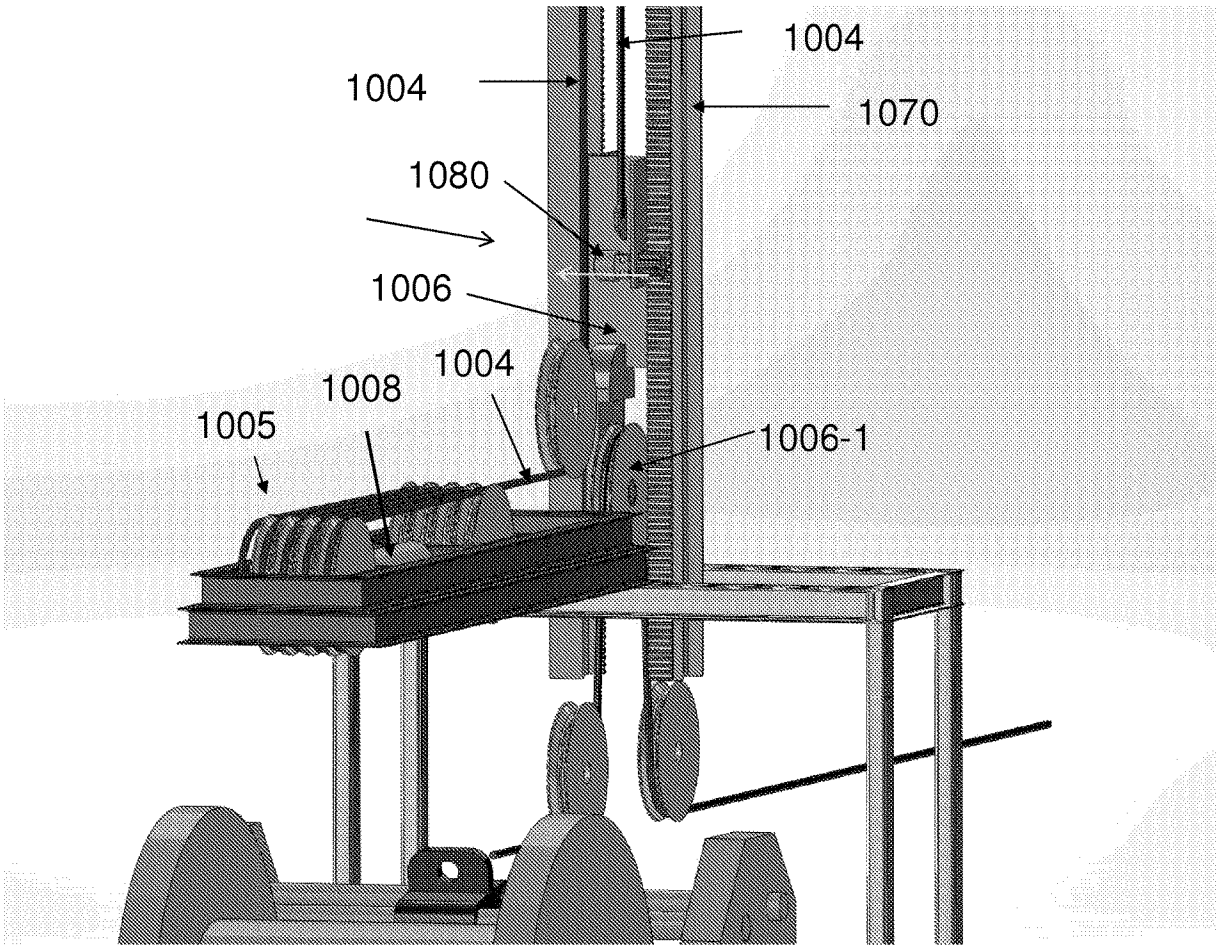
FIG. 21 shows an active compensation component of the flying sheave assembly, according to an aspect of the invention.
Figure 22:
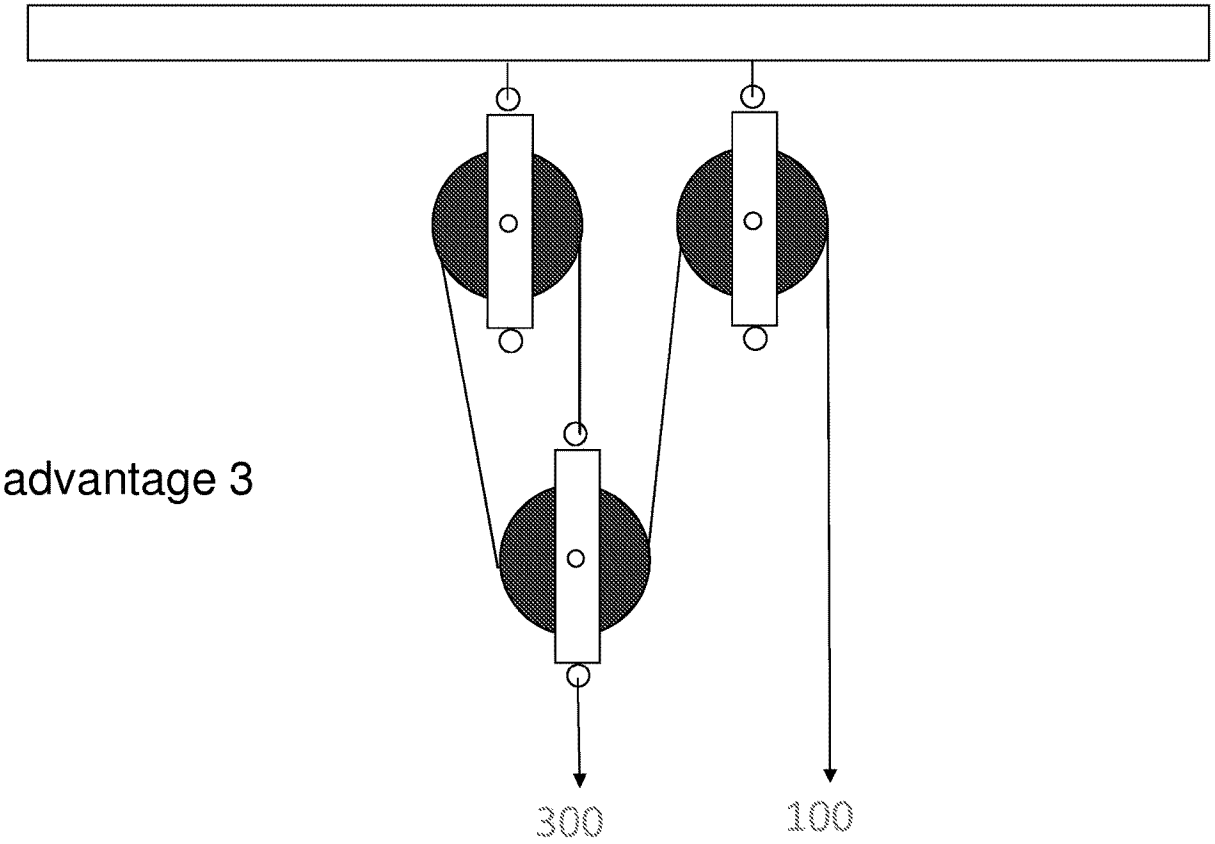
FIGS. 22, 23, 24, 25 respectively show block and tackle diagrams that illustrate different mechanical advantages that can be designed into the embodied invention.
Figure 23:
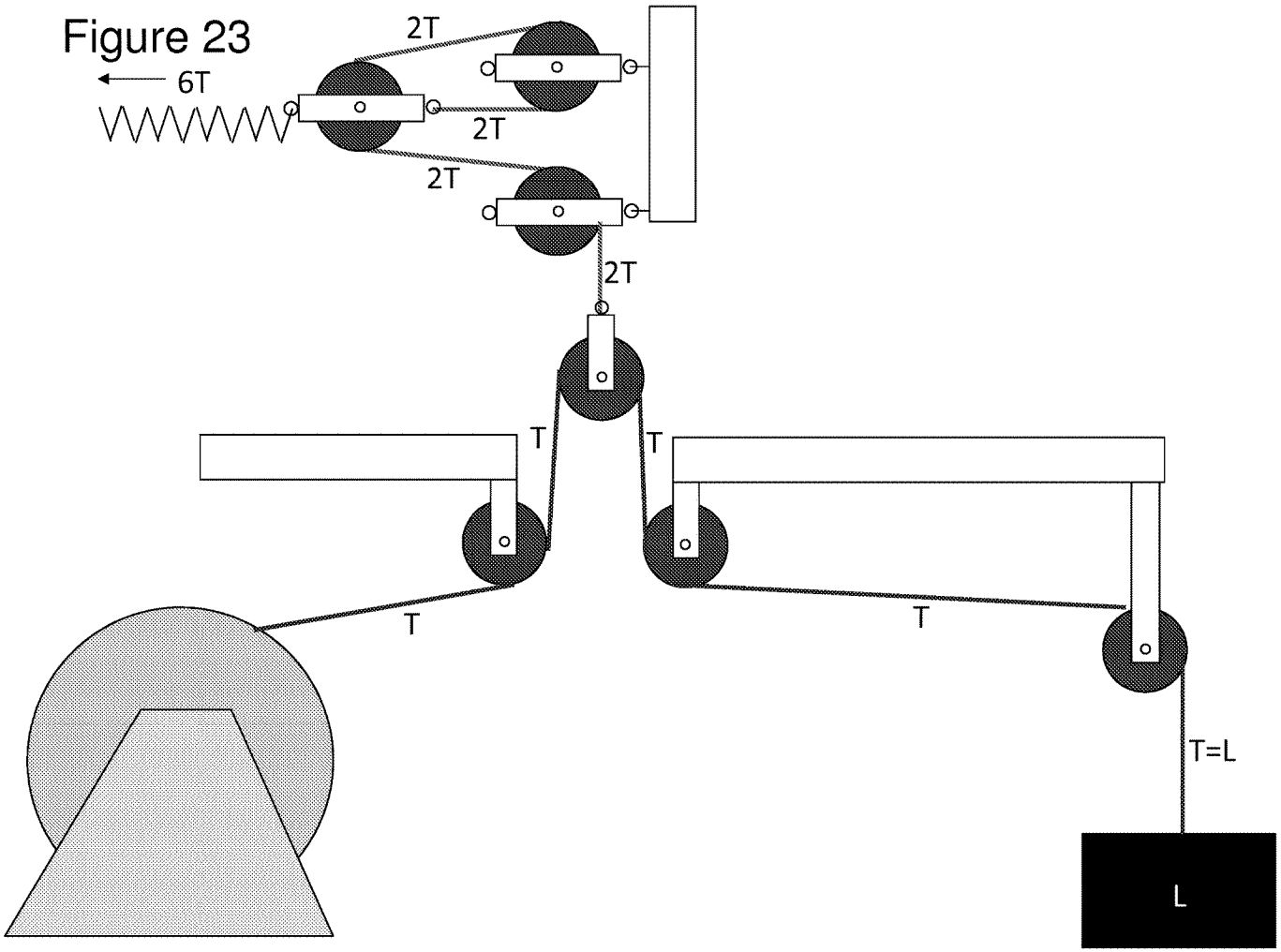
Figure 24:
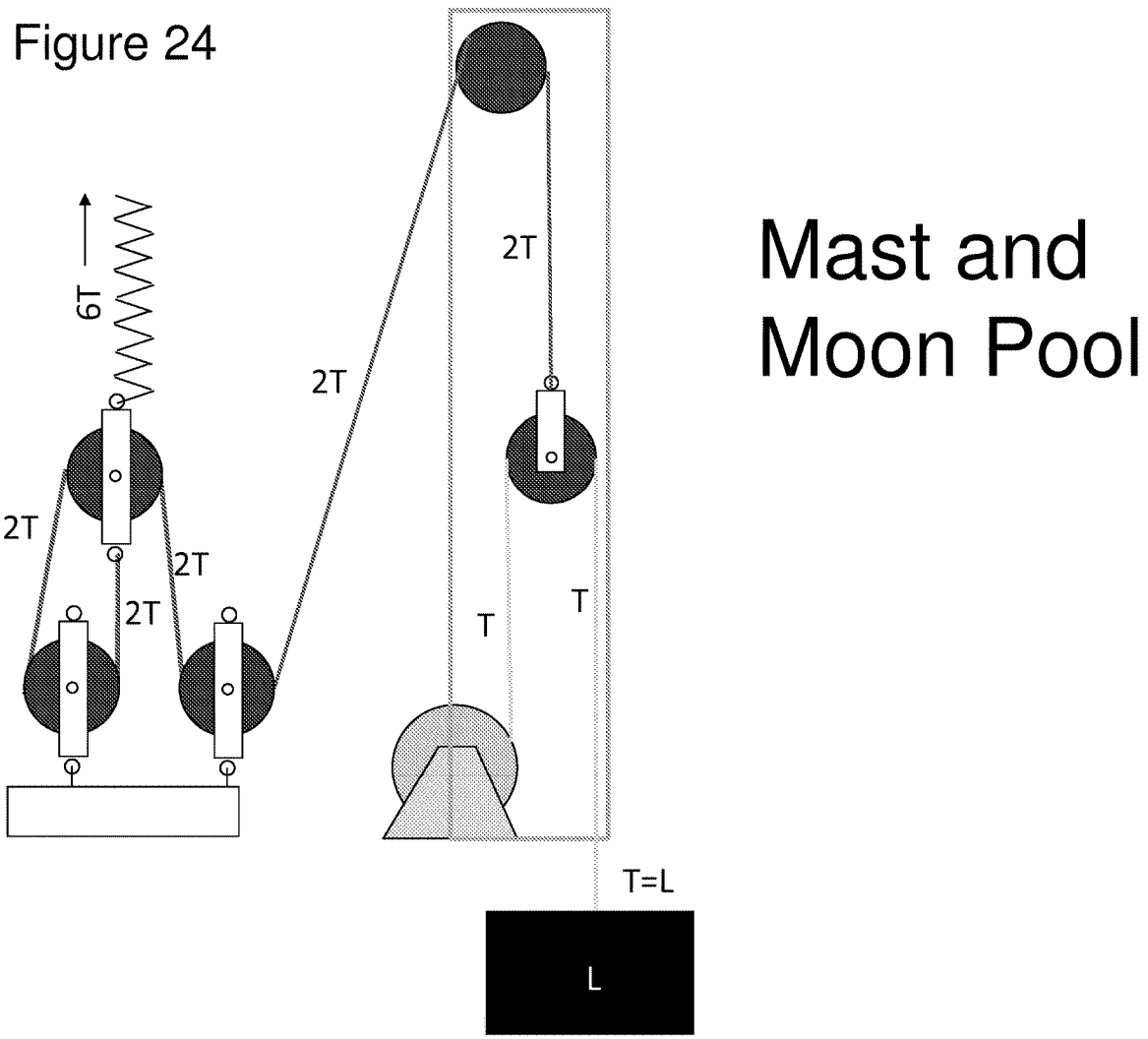
Figure 25:
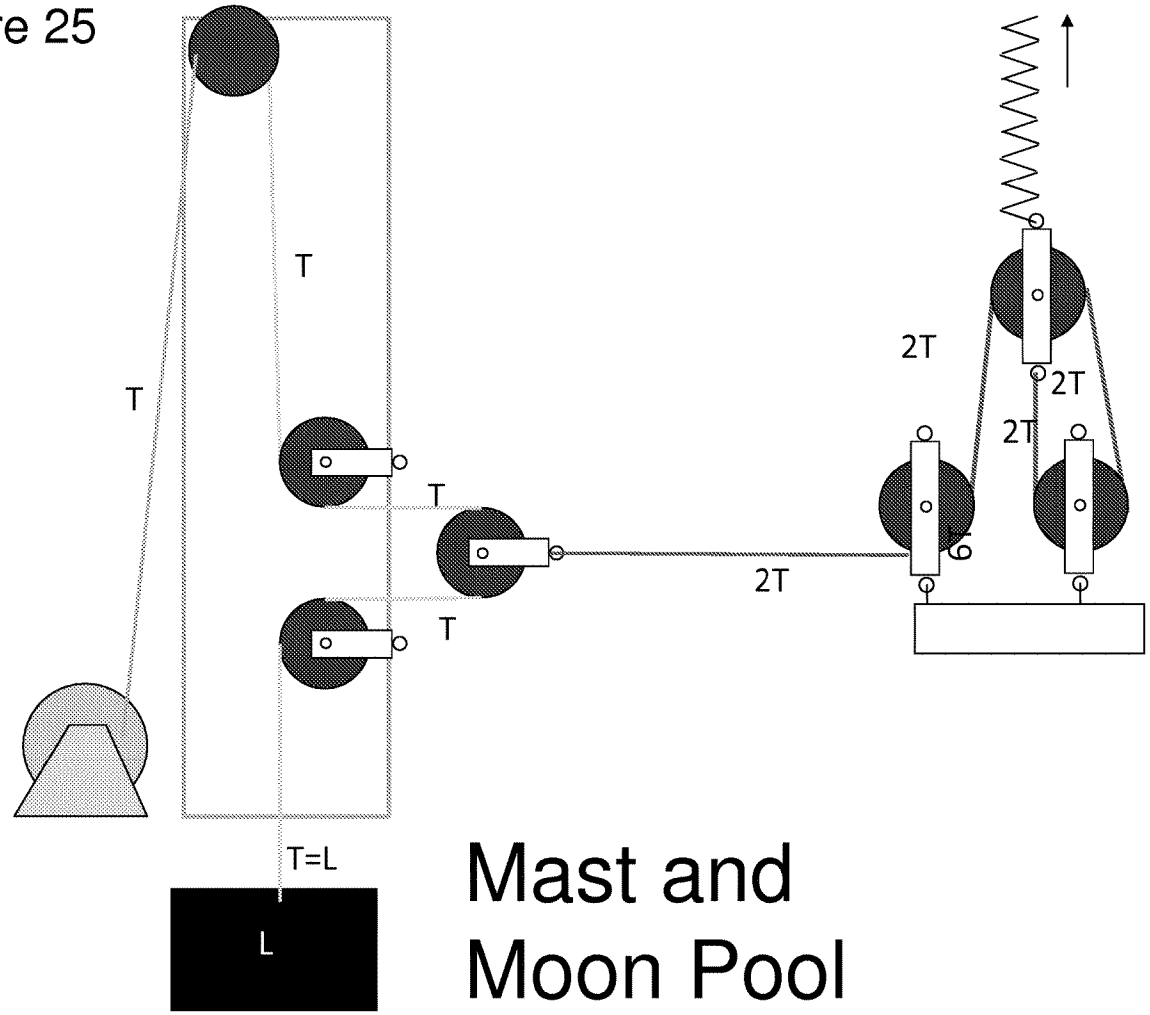

FIGS. 17-21 illustrate particular detailed aspects of an exemplary embodiment of the invention. Referring to FIGS. 17 and 21, the spring-line assembly 1002 includes a spring line actuating mechanism 1005 in the form of a gas spring 1008, which includes fixed and moveable sheaves separated by the spring 1008 (pneumatic, hydra-pneumatic, etc.). The figures further illustrate a flying sheave assembly guiding member 1070 within which the flying sheave assembly 1006 (and the connected flying sheave 1006-1) can controllably move in a linear direction. Referring to FIG. 19, fixed sheaves 1090 may, but need not be in operational contact with the load line 1030 when the apparatus is unengaged and non-path-altering.

It is to be appreciated that while the foregoing description of the embodied invention utilizes a spring line in the form of a rope or cable; i.e., a flexible spring line medium, the spring line 1004 as depicted in FIGS. 15 and 16 could comprise a rigid, inflexible medium such as, e.g., a rod, bar, or pole that can be used to move the flying sheave between a load line path-altering and load line non-path-altering positions. As such, the embodied payload control apparatus need not have a spring line actuating mechanism that includes a gas spring or equivalent component; rather, a flying sheave movably disposed by actuating machinery will be sufficient.

As further shown in FIG. 21, the flying sheave assembly may include an active compensator assembly 1080 operably coupled to the guiding structure and the spring-line flying sheave assembly. The active compensator includes a motion feedback control component of sensors and computational devices (not shown) controlling the motorized rack and pinion assembly 1080. The active compensator may also or alternatively comprise a hydraulic cylinder, a pneumatic cylinder, or a third driven line (not shown) to assist the motion of the flying sheave.

Advantageously, the spring line actuating machinery 1005 (e.g., gas spring 1008) may be oriented as needed or convenient anywhere on the vessel. Moreover, the spring line can have a nominal length of less than 200 feet, since it need only be long enough to extend from the flying sheave assembly 1006 and about the actuating machinery to compensate for gross heave distances in the unstable medium. As such, the spring line can be easily inspected and replaced if necessary, and be made arbitrarily strong. Most advantageously, the relatively long, heavy, expensive, and unwieldy load line is not required to, and does not traverse the sheaves of the gas-spring 1008 doing most of the heave compensation work.

As illustrated in FIGS. 22-25 and as will readily be appreciated by those skilled in the art, the spring line actuating mechanism (e.g., gas spring) can be designed to have an Nx mechanical advantage, N=3, 4, 5, 6, respectively, and the arrangement of components including added optional fixed sheaves 1090 is nearly limitless.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

I claim:

1. A payload control apparatus for controlling a payload coupled to a load line, comprising:

a spring line actuating mechanism;

only a single flying sheave, wherein the single flying sheave is disposed operatively engaged with the load line in an engaged condition and wherein the single flying sheave is disposed operatively disengaged with the load line in a disengaged condition;

a single, flexible spring line having one end connected to the spring line actuating mechanism and another end connected to the only the single flying sheave; and no more than two rotatable, stationary sheaves operatively coupled to a continuous, straight portion of the load line in the disengaged condition, wherein the single flying sheave assembly can be moveably disposed via the actuating mechanism into and out of the engaged and disengaged condition in a space intermediate the no more than two rotatable, stationary sheaves, wherein the load line extending vertically from a winch and into a body of water to lift and lower the payload;

the two rotatable, stationary sheaves being arranged vertically, one above the other;

the engaged and disengaged positions of flying sheave being relatively horizontally, wherein the engaged position occurring when the flying sheave essentially pulling the load line in a direction proximate the spring line actuator and the disengaged position occurring when the load line exists in a straight line position.

2. The apparatus of 1, wherein the load and at least a portion of the load-line are disposed in a water column.

3. The apparatus of 2, further comprising an active compensator operably coupled to the guiding structure and the single flying sheave.

4. The apparatus of 3, wherein the active compensator includes a motion feedback control component and at least one of a motorized rack and pinion assembly, a hydraulic cylinder, a pneumatic cylinder, a third driven line.

5. The apparatus of 1, wherein the spring line actuating mechanism includes a spring and at least one rotatable and movable sheave acted on by the spring.

6. The apparatus of 5, wherein the spring is a pneumatic spring.

7. The apparatus of 5, wherein the spring is a hydro-pneumatic spring.

8. The apparatus of 1, wherein the spring line actuating mechanism includes a passive heave compensation device of any form.

9. The apparatus of 1, wherein the one end of the spring line is affixed to an unmovable part of the spring line actuating mechanism.

* * * * *